US006135077A

United States Patent [19]

Moriya et al.

[11] Patent Number: 6,135,077

[45] Date of Patent: Oct. 24, 2000

[54] VALVE TIMING CHANGING APPARATUS FOR INTERNAL COMBUSTION ENGINE

[75] Inventors: Yoshihito Moriya, Nagoya; Kiyoshi Sugimoto, Okazaki; Tadao Hasegawa, Toyota, all of Japan

[73] Assignee: Toyota Jidosha Kabushiki Kaisha, Toyota, Japan

[21] Appl. No.: 09/186,667

[22] Filed: Nov. 4, 1998

[30] Foreign Application Priority Data

Nov. 7, 1997 [JP] Japan ..... 9-305996

[51] Int. Cl.[7] ..... F01L 1/344; F02D 13/02

[52] U.S. Cl. ..... 123/90.17; 123/90.15; 123/90.31

[58] Field of Search ..... 123/90.15, 90.17, 123/90.31

[56] References Cited

U.S. PATENT DOCUMENTS

| | | | |
|---|---|---|---|
| 2,037,051 | 4/1936 | Smiley . | |
| 5,181,485 | 1/1993 | Hirose et al. | 123/90.17 |
| 5,184,581 | 2/1993 | Aoyama et al. | 123/90.31 |
| 5,275,138 | 1/1994 | Hotta et al. | 123/90.17 |
| 5,497,737 | 3/1996 | Nakamura | 123/90.15 |
| 5,622,144 | 4/1997 | Nakamura et al. | 123/90.15 |
| 5,626,108 | 5/1997 | Kato et al. | 123/90.15 |
| 5,979,259 | 11/1999 | Shook et al. | 74/409 |

FOREIGN PATENT DOCUMENTS

| | | |
|---|---|---|
| 590696 | 4/1994 | European Pat. Off. . |
| 640749 | 3/1995 | European Pat. Off. . |
| 5-33615 | 2/1993 | Japan . |
| 5-118232 | 5/1993 | Japan . |
| 08 121 122 | 5/1996 | Japan . |

OTHER PUBLICATIONS

Moriya, Yoshihito et al., A Newly Developed Intelligent Variable Valve Timing System—Continously Controlled Cam Phasing as Aplied to a New 3 Liter Inline 6 Engine; Copyright 1996 Society of Automotive Engineers, Inc.; pp. 1–7.

*Primary Examiner*—Weilun Lo
*Attorney, Agent, or Firm*—Kenyon & Kenyon

[57] ABSTRACT

A valve timing changing apparatus for changing valve timings of intake and exhaust valves inhibits a deterioration in the precision of a change of a valve overlap period. A first variable valve timing mechanism (first VVT) is mounted to an intake cam shaft, and a second variable valve timing mechanism (second VVT) is mounted to a crank shaft. A timing belt drivingly couples a cam pulley mounted to an exhaust cam shaft, a cam pulley of the first VVT, and a cam pulley of the second VVT to one another. The first VVT changes a rotational phase of the intake cam shaft so as to change a valve timing of intake valves. The second VVT changes rotational phases of both the intake and exhaust cam shafts so as to simultaneously change valve timings of the intake and exhaust valves.

9 Claims, 13 Drawing Sheets

VALVE TIMING CHANGING APPARATUS FOR INTERNAL COMBUSTION ENGINE

INCORPORATION BY REFERENCE

The disclosure of Japanese Patent Application No. HEI 9-305996 filed on Nov. 7, 1997 including the specification, drawings and abstract is incorporated herein by reference in its entirety.

BACKGROUND OF THE INVENTION

1. Field of the Invention

The present invention relates to a valve timing changing apparatus for an internal combustion engine, which changes valve timings of intake and exhaust valves of the engine in accordance with, for example, an operational state of the engine.

2. Description of the Related Art

Intake and exhaust valves of internal combustion engines are reciprocally driven in accordance with the rotation of cam shafts, so that intake and exhaust ports opening into a combustion chamber of the engine are synchronously opened or closed, respectively. In a generally employed internal combustion engine, profiles of cams attached to the cam shafts determine the timings at which those valves are opened or closed, namely, valve timings.

On the other hand, some recently developed internal combustion engines are equipped with a valve timing changing apparatus for changing valve timings in accordance with an operational state of the engine. For example, this valve timing changing apparatus is designed to change valve timings such that, when the internal combustion engine is in an idle driving state, the valve overlap period during which intake and exhaust valves are simultaneously opened is decreased, and, when the engine is in a high-load driving state, the valve overlap period is increased. By changing valve timings in accordance with an operational state of the engine in this manner, it is possible to achieve a stable idle driving state and to enhance engine output as well as the intake efficiency during high-load driving.

For example, as such a valve timing changing apparatus, Japanese Patent Application Laid-Open No. HEI 5-118232 discloses "a valve timing control apparatus for an internal combustion engine". This apparatus employs variable valve timing mechanisms for both intake and exhaust cam shafts. These variable valve timing mechanisms are designed to change rotational phases of the intake and exhaust cam shafts so as to change the valve timings of intake and exhaust valves, respectively.

Because there is a certain limit to the control accuracy of the variable valve timing mechanisms of the aforementioned type, the actual valve timings constantly deviates from target valve timings. In other words, those variable valve timing mechanisms always suffer from control errors, which may be temporarily increased due to a possible response delay. Owing to such control errors, the valve overlap period substantially deviates from a desired length.

In order to change a valve overlap period to a length suited for an operational state of the engine, the aforementioned valve timing control apparatus wherein the valve timings of both the intake and exhaust valves are changed requires that both the variable valve timing mechanisms for the intake and exhaust cam shafts be controlled in such a manner as to set valve timings of the intake and exhaust valves to desired timings. However, in this case, respective control errors during valve timing control of the intake and exhaust valves are superposed on one another, so that the actual valve overlap period may further deviate from a target length.

SUMMARY OF THE INVENTION

The present invention has been made in view of this background. It is an object of the present invention to inhibit a deterioration in the precision of the changing of a valve overlap period by a valve timing changing apparatus that is used for an internal combustion engine and is designed to change valve timings of both intake and exhaust valves.

In order to achieve the aforementioned object, a first aspect of the present invention provides a valve timing changing apparatus for an internal combustion engine that includes an intake cam shaft, an exhaust cam shaft, a first actuating mechanism and a second actuating mechanism. The intake cam shaft drivingly opens and closes intake valves, and the exhaust cam shaft drivingly opens and closes exhaust valves. The first actuating mechanism simultaneously changes rotational phases of the intake and exhaust cam shafts, and the second actuating mechanism changes only one of rotational phases of the intake and exhaust cam shafts.

In the aforementioned construction, the first actuating mechanism simultaneously changes rotational phases of the intake and exhaust cam shafts, and the second actuating mechanism changes only one of rotational phases of the intake and exhaust cam shafts. As a result of such operation of the first and second actuating mechanisms, the valve timings of both the intake and exhaust valves are changed. Furthermore, according to the aforementioned construction, the valve overlap period is changed only by the operation of the second actuating mechanism. Therefore, the control accuracy of the first actuating mechanism does not adversely affect the precision in changing a valve overlap period.

In addition to the first aspect of the present invention, the first and second actuating mechanisms may operate so as to advance or retard at least one of the valve timings of the intake and exhaust valves by means of a hydraulic pressure supplied from a hydraulic pressure source.

In order to achieve the aforementioned object, according to a second aspect of the present invention, the valve timing changing apparatus of the first aspect is constructed such that at least one of the first and second actuating mechanisms is provided with return means for forcibly advancing or retarding at least one of the valve timings of the intake and exhaust valves when a desired operation becomes impossible to perform due to a decrease in hydraulic pressure supplied from the hydraulic pressure source.

In order to achieve the aforementioned object, according to a third aspect of the present invention, the valve timing changing apparatus of the first aspect is constructed as follows. That is, when the first and second actuating mechanisms become incapable of performing a desired operation due to a decrease in hydraulic pressure supplied from the hydraulic pressure source, one of the actuating mechanisms is maintained in a most advanced state where the aforementioned one of the intake and exhaust valve timings is most advanced, and the other of the actuating mechanisms is maintained in a most retarded state where the aforementioned one of the intake and exhaust valve timings is most retarded.

In the aforementioned construction, when the first and second actuating mechanisms become incapable of performing a desired operation due to a decrease in hydraulic pressure supplied from the hydraulic pressure source, one of the actuating mechanisms is maintained in the most advanced state, and the other is maintained in the most retarded state.

Unlike the case with the present invention, if a construction is employed wherein both the actuating mechanisms are maintained in either the most advanced state or the most retarded state, when a desired operation becomes impossible to perform, the valve timings are set to either a most advanced timing or a most retarded timing. In this state, the internal combustion engine continues to operate. Hence, even if the intake or exhaust valves are opened or closed at the most advanced timing or at the most retarded timing, the internal combustion engine operates properly in various operation areas ranging from an idle driving state to a high-load driving state. Consequently, the range where the valve timings can be changed is inevitably restricted.

In view of this drawback, the present invention sets at least one of the valve timings of the intake and exhaust valves to an intermediate timing between the most advanced and the most retarded timings. Therefore, there is no need to set the most advanced timing or the most retarded timing of the aforementioned one of the intake and exhaust valve timing in consideration of a case where both the actuating mechanisms become incapable of performing a desired operation.

Further, the aforementioned aspects of the present invention may be designed such that the first actuating mechanism is disposed concentrically with respect to the crank shaft and changes rotational phase of the crank shaft relative to at least one of the intake and exhaust cam shafts coupled to the first actuating mechanism.

Further, the aforementioned aspects of the present invention may also be designed such that the first actuating mechanism is disposed concentrically with respect to one of the intake and exhaust cam shafts and changes a rotational phase of the crank shaft relative to one of the intake and exhaust cam shafts, the first actuating mechanism being disposed concentrically with respect to the aforementioned one of the intake and exhaust cam shafts.

Still further, the aforementioned aspects of the present invention may also be designed such that the second actuating mechanism is disposed concentrically with respect to one of the intake and exhaust cam shafts and changes a rotational phase of one of the intake and exhaust cam shafts relative to the other, the second actuating mechanism being disposed concentrically with respect to the aforementioned one of the intake and exhaust cam shafts.

Still further, in the aforementioned aspects of the present invention, each of the first and second actuating mechanisms can be constituted by one of a gear-type variable valve timing mechanism and a rotarytype variable valve timing mechanism.

BRIEF DESCRIPTION OF THE DRAWINGS

The foregoing and further objects, features and advantages of the present invention will become apparent from the following description of preferred embodiments with reference to the accompanying drawings, wherein.

DETAILED DESCRIPTION OF THE PREFERRED EMBODIMENTS

[First Embodiment]

A first embodiment of the present invention will be described hereinafter with reference to FIGS. 1 through 5.

Figure 1:
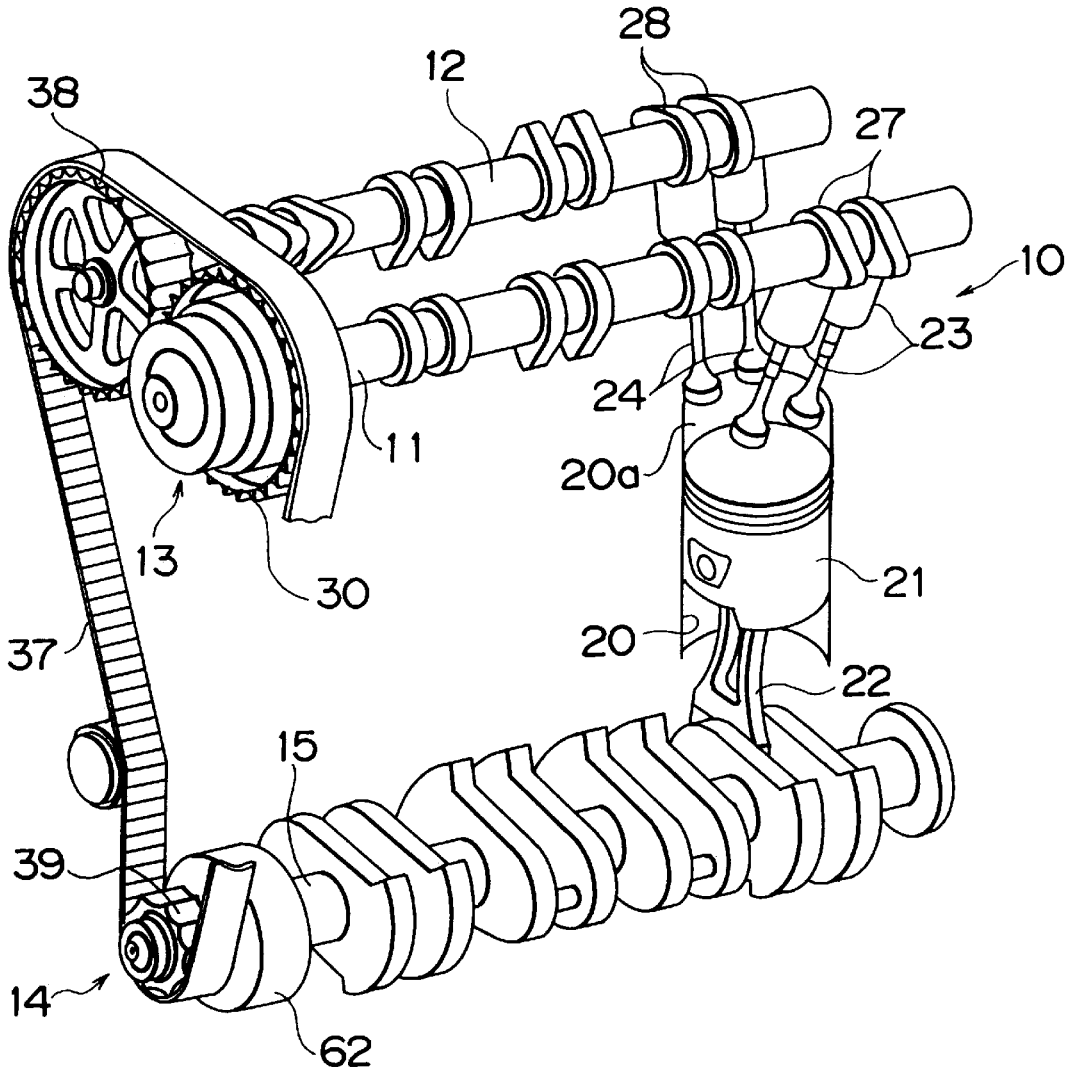
FIG. 1 is a schematic structural view of a valve timing changing apparatus according to a first embodiment of the present invention.

FIG. 1 schematically shows the structure of a valve timing changing apparatus installed in a four-valve inline engine 10 (hereinafter referred to simply as "engine ") mounted to a vehicle. As shown in FIG. 1, the engine 10 is provided with an intake cam shaft 11, an exhaust cam shaft 12, a first variable valve timing mechanism 13 (hereinafter referred to simply as "first VVT") as a second actuating mechanism mounted to the intake cam shaft 11, a crank shaft 15, a second variable valve timing mechanism 14 (hereinafter referred to simply as "second VVT") as a first actuating mechanism mounted to the crank shaft 15, and the like.

The engine 10 has a cylinder block (not shown), a cylinder head (not shown) securely laid on the cylinder block, and an oil pan (not shown) fixed to a lower side of the cylinder block. The oil pan stores oil therein, which is supplied to various portions of the engine 10 as lubricating oil and is also supplied to the aforementioned VVT's 13, 14 as hydraulic fluid.

The cylinder block includes a plurality of cylinders 20 each having a combustion chamber 20*a*. Although the cylinder block of this embodiment includes a total of four cylinders 20, FIG. 1 shows only one of those cylinders 20.

The crank shaft 15 is rotatably supported by the cylinder block and a bearing cap (not shown). Each of the cylinders 20 has a piston 21 therein, which is connected to the crank shaft 15 via a connecting rod 22. In accordance with the combustion of air/fuel mixture in the combustion chamber 20*a*, the piston 21 moves in up-and-down directions, whereby the crank shaft 15 rotates.

The cylinder head includes a plurality of intake valves 23 and exhaust valves 24 corresponding to the respective cylinders 20. Further, the cylinder head is provided with intake ports (not shown) and exhaust ports (not shown) each communicating with the combustion chamber 20*a*. Each of the intake ports is connected to an intake passage (not shown), and each of the exhaust ports is connected to an exhaust passage (not shown). A throttle valve (not shown) disposed in an intake passage adjusts the amount of intake air introduced into the combustion chamber 20*a* from the intake port through the intake passage.

A crank pulley 39 is attached to the crank shaft 15 at its front end portion (at a left end portion in FIG. 1), and cam pulleys 30, 38 are attached to the cam shafts 11, 12 respectively at their front end portions. A timing belt 37 is hung around the crank pulley 39 and the cam pulleys 30, 38. Accordingly, torque is transmitted from the crank shaft 15 to the cam pulleys 30, 38 via the crank pulley 39 and the timing belt 37. The torque thus transmitted to the cam pulleys 30, 38 is further transmitted to the cam shafts 11, 12.

The intake and exhaust cam shafts 11, 12 have a plurality of pairs of cams 27, 28 respectively. The cams 27 or 28 constituting each pair are spaced apart from each other by a predetermined distance in the axial direction of the intake or exhaust cam shaft 11 or 12 respectively. The cams 27, 28 reciprocally drive the intake and exhaust valves 23, 24 in accordance with the cam shafts 11, 12 respectively. The intake and exhaust valves 23, 24 open or close the intake and exhaust ports in accordance with reciprocating movements of the cams 27, 28 respectively.

Figure 2:
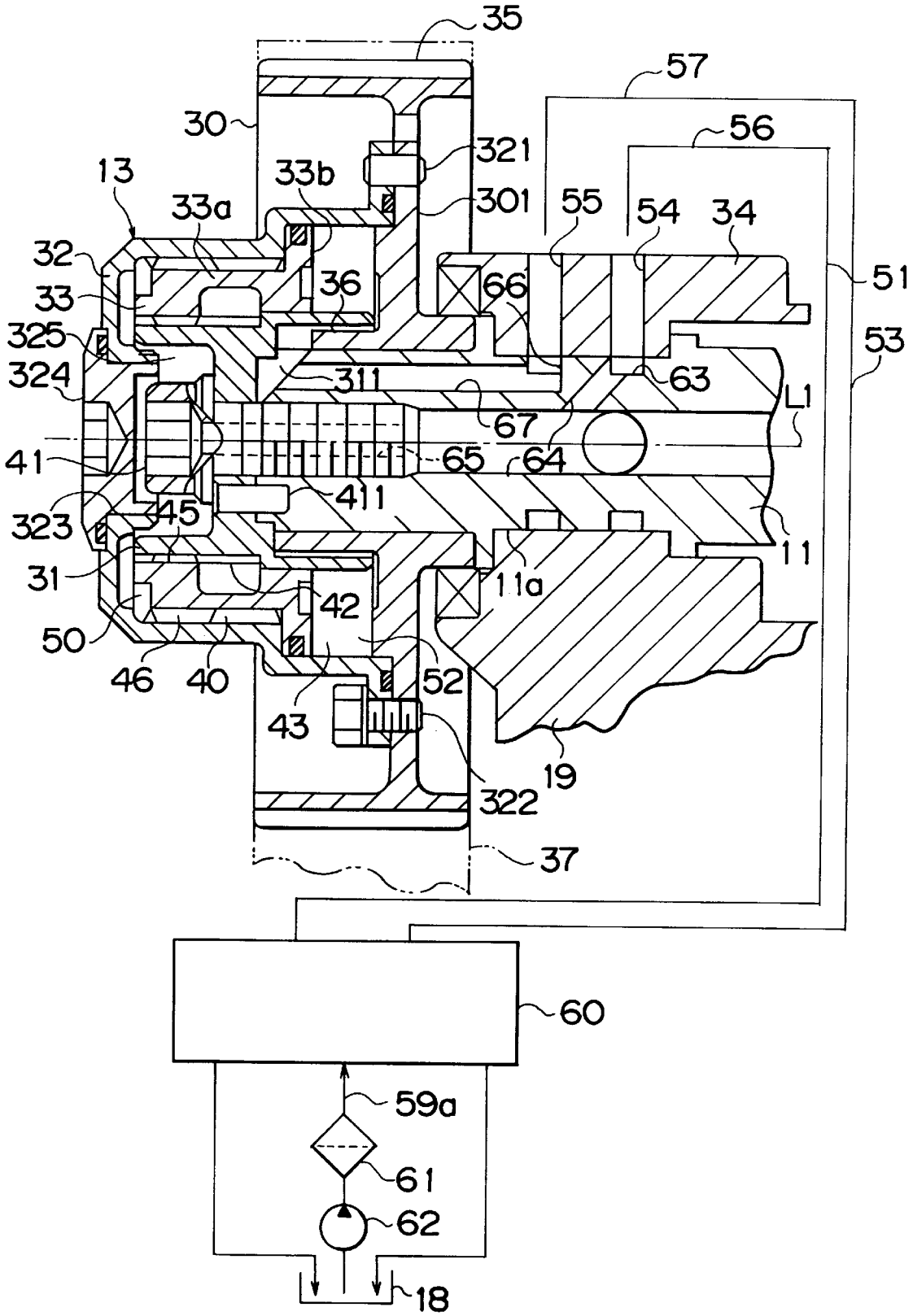
FIG. 2 is a sectional view of a first VVT and an intake cam shaft.

The first VVT 13 will now be described. FIG. 2 is a sectional view of the first VVT 13 and the intake cam shaft 11.

As shown in FIG. 2, the first VVT 13 is provided with the cam pulley 30, an inner cap 31, a cover 32, a ring gear 33 and the like. The intake cam shaft 11 is rotatably supported at its journal 11*a* by a cylinder head 19 and a bearing cap 34. The cam pulley 30 is composed of a disc portion 301 and a boss 36 formed at the center of the disc portion 301. A plurality of outer teeth 35 are formed along the outer circumference of the disc portion 301, and the timing belt 37 is hung on the outer teeth 35. The cam pulley 30 is rotatably attached at the boss 36 to the front end portion (on the left side in FIG. 2) of the intake cam shaft 11.

The cover 32 is substantially in the shape of a cylinder with a closed bottom. The cover 32 covers the front end face of the disc portion 301 and the front end portion of the intake cam shaft 11. A hole 323 is formed through the cover 32 at its center and is closed by a cap 324. The cover 32 is fixed to the disc portion 301 by means of a plurality of pins 321 and bolts 322. Therefore, the cam pulley 30 rotates integrally with the cover 32.

In addition, a plurality of inner teeth 40 are formed along the inner circumference of the cover 32 at its front end portion. The inner teeth 40 are helical teeth. That is, each of the inner teeth 40 has a tooth trace that is inclined by a predetermined angle with respect to an axis L1 of the intake cam shaft 11.

The inner cap 31 is attached to the front end portion of the intake cam shaft 11 by means of a hollow bolt 41. Being unmovably fixed to the intake cam shaft 11 by means of a pin 411, the inner cap 31 rotates integrally with the intake cam shaft 11. Further, a plurality of outer teeth 42 are formed along the outer circumference of the inner cap 31. The outer teeth 42 are helical teeth of the same type as the inner teeth 40 of the cover 32.

The cam pulley 30, the cover 32 and the inner cap 31 define an annular space 43, in which the ring gear 33 is disposed. The ring gear 33 has a cylindrical gear portion 33*a* and a flange-like pressure-receiving portion 33*b*. While the gear portion 33*a* is located on the front end side of the ring gear 33, the pressure-receiving portion 33*b* is located on the base end side of the ring gear 33. A plurality of inner and outer teeth 45, 46 are formed along the inner and outer circumferences of the gear portion 33*a* respectively. The inner and outer teeth 45, 46 are helical teeth of the same type as the inner teeth 40. The inner teeth 45 engage the outer teeth 42 of the inner cap 31, and the outer teeth 46 engage the inner teeth 40 of the cover 32. Accordingly, the torque that has been transmitted to the cam pulley 30 is transmitted to the intake cam shaft 11 via the ring gear 33 and the inner cap 31.

The ring gear 33 divides the annular space 43 into two pressure chambers 50, 52. That is, a part of the annular space 43 located on the front end side (on the left side in FIG. 2) with respect to the ring gear 33 constitutes the first pressure chamber 50, and another part of the annular space 43 located on the base end side (on the right side in FIG. 2) with respect to the ring gear 33 constitutes the second pressure chamber 52.

First and second pressure passages 51, 53 for supplying oil to the first and second pressure chambers 50, 52 respectively will now be described.

A pair of oil holes 54, 55 are formed in the bearing cap 34. The oil holes 54, 55 are connected to a first oil control valve 60 (hereinafter referred to simply as "first OCV") via oil passages 56, 57 respectively.

An oil groove 63 is formed along the entire circumference of the journal lla of the intake cam shaft 11. The oil hole 54 located on the base end side (on the right side of FIG. 2) communicates with an oil passage 64 formed inside the intake cam shaft 11, via the oil groove 63. Further, the inner cap 31, the cover 32 and the cap 324 define a space 325 leading to the first pressure chamber 50.

A central hole 65 axially penetrates the hollow bolt 41, and the oil passage 64 communicates with the space 325 via the central hole 65. The oil passage 56, the oil hole 54, the oil groove 63, the oil passage 64, the central hole 65 and the space 325 constitute the first pressure passage 51.

On the other hand, another oil groove 66 is formed along the entire circumference of the journal 11*a* of the intake cam shaft 11, on the front end side with respect to the oil groove 63. The oil groove 66 is connected to the oil hole 55 located on the front end side (on the left side in FIG. 2). Furthermore, an oil passage 67 connected to the oil groove 66 is formed inside the intake cam shaft 11. The oil passage 67 is connected to the second pressure chamber 52 via a space 311, which is formed between the inner cap 31 on one hand and the front end side portion of the intake cam shaft 11 and the boss 36 on the other hand. The oil passage 57, the oil hole 55, the oil groove 66, the oil passage 67 and the space 311 constitute the second pressure passage 53.

A construction for supplying oil to the first and second pressure passages 51, 53 will now be described.

As shown in FIG. 1, an oil pump 62 is drivingly coupled to the crank shaft 15. The oil pump 62 operates in accordance with rotation of the crank shaft 15. The oil pump 62 sucks oil that is stored in the oil pan 18 shown in FIG. 2 and forcefully sends the oil to the first OCV 60 via a discharge passage 59*a*, in which an oil filter 61 for trapping foreign matters contained in oil is provided.

By being subjected to duty control by an electronic control unit (not shown) of the engine 10, the first OCV 60 selectively supplies oil to or discharge oil from the pressure chambers 50, 52 through the first and second pressure passages 51, 53 respectively.

For example, due to the operation of the first OCV 60, oil is supplied to the first pressure chamber 50 through the first pressure passage 51, and oil in the second pressure chamber 52 is returned to the oil pan 18 through the second pressure passage 53. This results in an increase in hydraulic pressure in the first pressure chamber 50 and a decrease in hydraulic pressure in the second pressure chamber 52. Consequently, the ring gear 33 moves toward the second pressure chamber 52 while rotating upon the axis of the intake cam shaft 11, due to an urging force based on an increased hydraulic pressure in the first pressure chamber 50.

Due to such movement of the ring gear 33, such a torque as to cause the inner cap 31 to rotate relative to the cam pulley 30 is applied to the inner cap 31, which engages the ring gear 33 via the helical teeth. Accordingly, the inner cap 31 and the intake cam shaft 11 rotate relative to the cam pulley 30, whereby their rotational phases relative to the cam pulley 30 are changed. As a result, the valve timing of the intake valves 23 is advanced, as compared with the current valve timing thereof.

If the ring gear 33 moves toward the second pressure chamber 52 while rotating as described above, it finally stops at a position where a base end face of the pressure-receiving portion 33*b* abuts on the disc portion 301 of the cam pulley 30. In this state, as indicated by a solid line in FIG. 4, the valve timing of the intake valves 23 is most advanced by the first VVT 13 (it is to be noted herein that the first VVT 13 assumes a most advanced state).

On the other hand, due to the operation of the first OCV 60, oil is supplied to the second pressure chamber 52 through the second pressure passage 53, and oil in the first pressure chamber 50 is returned to the oil pan 18 through the first pressure passage 51. This results in an increase in hydraulic pressure in the second pressure chamber 52 and a decrease in hydraulic pressure in the first pressure chamber 50. Consequently, the ring gear 33 moves toward the first pressure chamber 50 while rotating upon the axis of the intake cam shaft 11, due to an urging force based on an increased hydraulic pressure in the second pressure chamber 52.

Due to such movement of the ring gear 33, the intake cam shaft 11 rotates relative to the cam pulley 30 in a direction opposite to the case where the valve timing of the intake valves 23 is advanced. This relative rotation changes a rotational phase of the intake cam shaft 11 relative to the cam pulley 30, whereby the valve timing of the intake valves 23 is retarded, as compared with the current valve timing thereof.

If the ring gear 33 moves toward the first pressure chamber 50 while rotating as described above, it finally stops at a position where a front end face of the pressure-receiving portion 33*b* abuts on the cover 32, as can be seen from FIG. 2. In this state, as indicated by an alternate long and two short dashes line in FIG. 4, the valve timing of the intake valves 23 is most retarded by the first VVT 13 (it is to be noted herein that the first VVT 13 assumes a most retarded state).

On the other hand, due to the operation of the first OCV 60, oil is stopped from being supplied to or discharged from the pressure chambers 50, 52, whereby internal volumes of the pressure chambers 50, 52 are determined. As a result, the ring gear 33 stops moving and the valve timing of the intake valves 23 is maintained as it is.

By thus operating the first VVT 13, it is possible to continuously retard or advance a valve timing of the intake valves 23 so as to maintain it at a desired timing.

Figure 3:
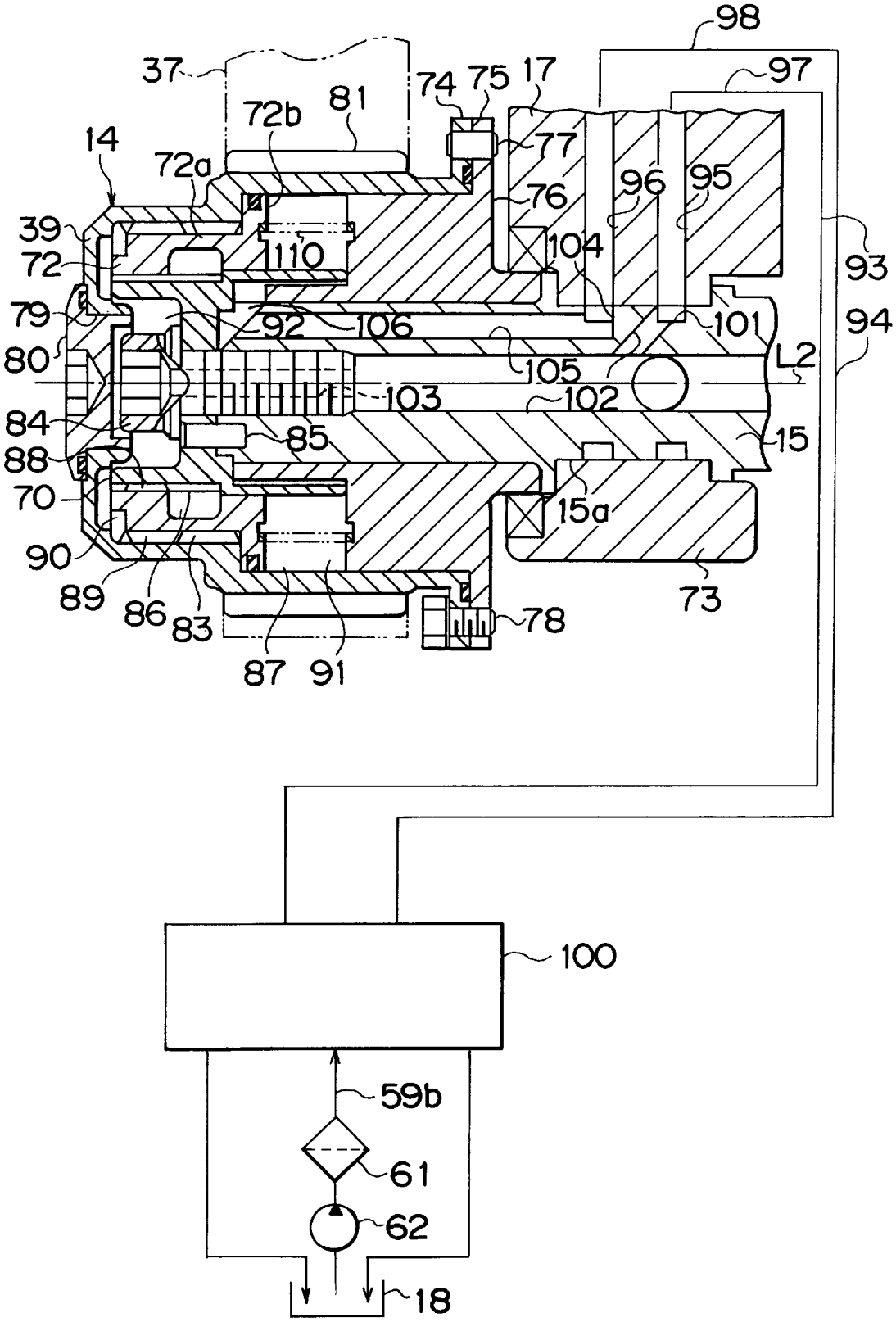
FIG. 3 is a sectional view of a second VVT and a crank shaft.
Figure 4:
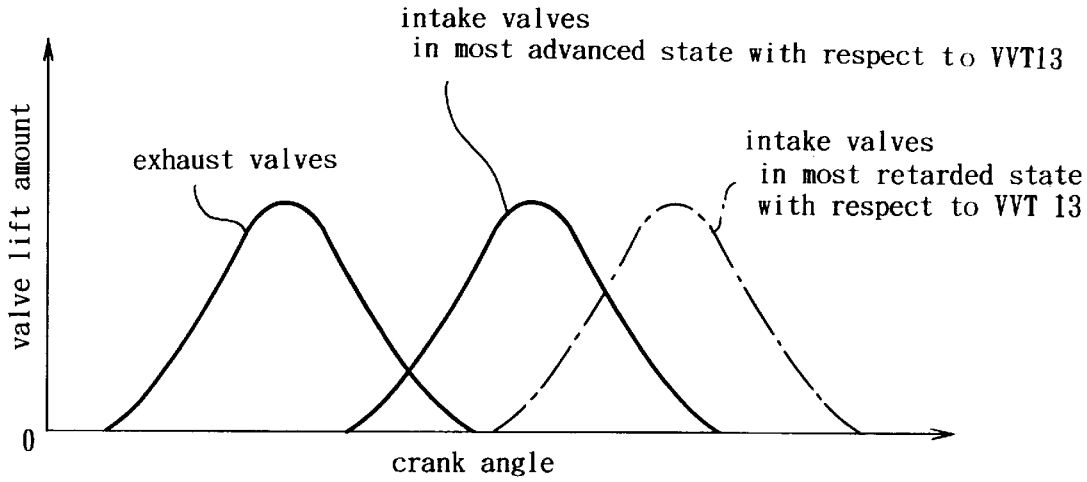
FIG. 4 is a graph showing valve timings of intake valves changed by the first VVT.
Figure 5:
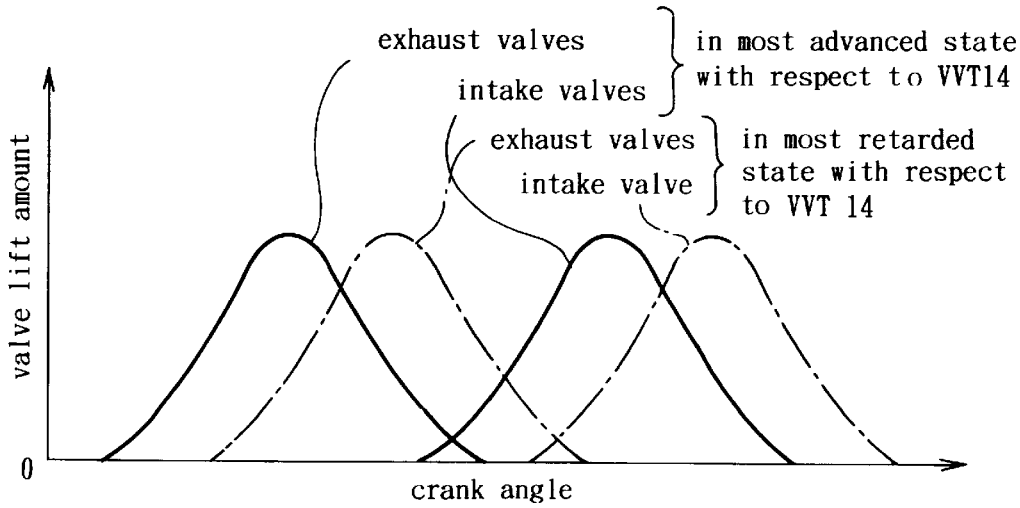
FIG. 5 is a graph showing valve timings of the intake and exhaust valves changed by the second VVT.

The second VVT 14 will now be described. FIG. 3 is a sectional view of the second VVT 14 and the crank shaft 15.

As shown in FIG. 3, the second VVT 14 is provided with a crank pulley 39, an inner cap 70, a ring gear 72 and the like. The crank shaft 15 is rotatably supported at its journal 15*a* by a cylinder block 17 and a bearing cap 73.

A sleeve 76 with a flange 75 is fitted onto the outer circumference of the front end side of the crank shaft 15 such that the sleeve 76 can rotate relative to the crank shaft 15. The crank pulley 39 is in the shape of a cylinder with a closed bottom and covers the front end portion of the crank shaft 15 and the outer circumference portion of the sleeve 76. A hole 79 is formed through the crank pulley 39 at its bottom center and is closed by a cap 80.

In addition, a flange 74 is formed along the circumference of the crank pulley 39 at the base end side thereof. The flange 74 is fixed to the flange 75 of the sleeve 76 by means of a plurality of pins 77 and bolts 78. Therefore, the crank pulley 39 and the sleeve 76 can rotate integrally relative to the crank shaft 15. A plurality of teeth 81 are formed along the outer circumference of the crank pulley 39, and the timing belt 37 is hung on the teeth 81. On the other hand, a plurality of inner teeth 83 are formed along the inner circumference of the crank pulley 39 at its front end side. The inner teeth 83 are helical teeth. That is, each of the inner teeth 83 has a tooth trace that is inclined by a predetermined angle with respect to an axis L2 of the crank shaft 15.

The inner cap 70 is attached to the front end of the crank shaft 15 by means of a hollow bolt 84. Being fixed to the front end portion of the crank shaft 15 by means of a pin 85, the inner cap 70 rotates integrally with the crank shaft 15. Further, a plurality of outer teeth 86 are formed along the outer circumference of the inner cap 70. The outer teeth 86 are helical teeth of the same type as the inner teeth 83 of the crank pulley 39.

The crank pulley 39, the sleeve 76 and the inner cap 70 define an annular space 87, in which the ring gear 72 is disposed. The ring gear 72 has a cylindrical gear portion 72*a* and a flange-like pressure-receiving portion 72*b*. While the gear portion 72*a* is located on the front end side of the ring gear 72, the pressure-receiving portion 72*b* is located on the base end side of the ring gear 72. A plurality of inner and outer teeth 88, 89 are formed along the inner and outer circumferences of the gear portion 72*a* respectively. The inner and outer teeth 88, 89 are helical teeth of the same type as the inner teeth 83. The inner teeth 88 engage the outer teeth 86 of the inner cap 70, and the outer teeth 89 engage the inner teeth 83 of the crank pulley 39. Accordingly, the torque that has been transmitted to the crank pulley 39 is transmitted to the crank shaft 15 via the ring gear 72 and the inner cap 70.

The ring gear 72 divides the annular space 87 into two pressure chambers 90, 91. That is, a part of the annular space 87 located on the front end side (on the left side in FIG. 3) with respect to the ring gear 72 constitutes the first pressure chamber 90, and another part of the annular space 87 located on the base end side (on the right side in FIG. 3) with respect to the ring gear 72 constitutes the second pressure chamber 91.

A coil-like return spring 110 is provided in the second pressure chamber 91 as advancing means, and the return spring 110 is fixed at one end to the pressure-receiving portion 72*b* and at the other end to the sleeve 76. The return spring 110 constantly urges the ring gear 72 toward the first pressure chamber 90.

First and second pressure passages 93, 94 for supplying oil to the first and second pressure chambers 90, 91 respectively will now be described.

A pair of oil holes 95, 96 are formed in the cylinder block 17. The oil holes 95, 96 are connected to a second oil control valve 100 (hereinafter referred to simply as "second OCV") via oil passages 97, 98 respectively.

An oil groove 101 is formed along the entire circumference of the journal 15*a* of the crank shaft 15. The oil groove 101 is connected to the oil hole 95 located on the base end side (on the right side of FIG. 3). An oil passage 102 leading to the oil groove 101 is formed inside the crank shaft 15. Further, the inner cap 70, the crank pulley 39, the cap 80 and the hollow bolt 84 define a space 92 leading to the first pressure chamber 90.

A central hole 103 axially penetrates the hollow bolt 84, and the oil passage 102 communicates with the space 92 via the central hole 103. The oil passage 97, the oil hole 95, the oil groove 101, the oil passage 102, the central hole 103 and the space 92 constitute the first pressure passage 93.

On the other hand, another oil groove 104 is formed along the entire circumference of the journal 15*a* of the crank shaft 15, on the front end side with respect to the oil groove 101. The oil groove 104 is connected to the oil hole 96 located on the front end side (on the left side in FIG. 3). Furthermore, an oil passage 105 leading to the oil groove 104 is formed inside the crank shaft 15. The oil passage 105 is connected to the second pressure chamber 91 via a space 106, which is formed between the inner cap 70 on one hand and the front end side portion of the crank shaft 15 and the sleeve 76 on the other hand. The oil passage 98, the oil hole 96, the oil groove 104, the oil passage 105 and the space 106 constitute the second pressure passage 94.

A construction for supplying oil to the first and second pressure passage 93, 94 will now be described.

The second OCV 100 is connected to the oil pump 62 through the discharge passage 59*b*. As is the case with the first OCV 60, by being subjected to duty control by the electronic control unit, the second OCV 100 selectively supplies oil to or discharge oil from the pressure chambers 90, 91 through the first and second pressure passages 93, 94 respectively.

For example, due to the operation of the second OCV 100, oil is supplied to the first pressure chamber 90 through the first pressure passage 93, and oil in the second pressure chamber 91 is returned to the oil pan 18 through the second pressure passage 94. This results in an increase in hydraulic pressure in the first pressure chamber 90 and a decrease in hydraulic pressure in the second pressure chamber 91. Consequently, the ring gear 72 moves toward the second pressure chamber 91 while rotating upon the axis of the crank shaft 15, due to an urging force based on a hydraulic pressure in the first pressure chamber 90.

Due to such movement of the ring gear 72, the crank pulley 39 rotates relative to the crank shaft 15. Thereby, the rotational phase of the crank pulley 39 relative to the crank shaft 15 is changed, and the rotational phases of the cam pulleys 30, 38, which are drivingly coupled to the crank pulley 39 via the timing belt 37, are also changed. As a result, the valve timing of the intake and exhaust valves 23, 24 are simultaneously retarded by an equal phase, as compared with the current valve timing thereof.

If the ring gear 72 moves toward the second pressure chamber 91 while rotating as described above, it finally stops at a position where the return spring 110 assumes its minimum length. In this state, as indicated by an alternate long and short dash line in FIG. 5, the valve timing of the intake and exhaust valves 23, 24 are most retarded by the second VVT 14 (it is to be noted herein that the second VVT 14 assumes a most retarded state).

On the other hand, due to the operation of the second OCV 100, oil is supplied to the second pressure chamber 91 through the second pressure passage 94, and oil in the first pressure chamber 90 is returned to the oil pan 18 through the first pressure passage 93. This results in an increase in hydraulic pressure in the second pressure chamber 91 and a decrease in hydraulic pressure in the first pressure chamber 90. Consequently, the ring gear 72 moves toward the first pressure chamber 90 while rotating upon the axis of the crank shaft 15, due to an urging force based on a hydraulic pressure in the second pressure chamber 91.

Due to such movement of the ring gear 72, the crank pulley 39 rotates relative to the crank shaft 15 in a direction opposite to the case where the valve timing of the intake and exhaust valves 23, 24 is retarded. This relative rotation changes a rotational phase of the crank pulley 39 relative to the crank shaft 15 as well as rotational phases of the cam pulleys 30, 38. As a result, the valve timing of the intake and exhaust valves 23, 24 is simultaneously advanced by an equal phase, as compared with the current valve timing thereof.

If the ring gear 72 moves toward the first pressure chamber 90 while rotating as described above, it finally stops at a position where a front end face of the pressure-receiving portion 72*b* abuts on the crank pulley 39, as can be seen from FIG. 3. In this state, as indicated by a solid line in FIG. 5, the valve timing of the intake and exhaust valves 23, 24 is most advanced by the second VVT 14 (it is to be noted herein that the second VVT 14 assumes a most advanced state).

On the other hand, due to the operation of the second OCv 100, oil is stopped from being supplied to or discharged from the pressure chambers 90, 91, whereby internal volumes of the pressure chambers 90, 91 are determined. As a result, the ring gear 72 stops moving and the current valve timing of the intake and exhaust valves 23, 24 is maintained.

By thus operating the second VVT 14, it is possible to simultaneously retard or advance valve timing of the intake and exhaust valves 23, 24 by an equal phase so as to maintain them at desired timings.

According to this embodiment, the first and second VVT's 13, 14 are operated as described above, so that the valve timing of the intake and exhaust valves 23, 24 can be changed to timings suited for an operational state of the engine 10 and maintained at those timings. Also, according to this embodiment, while the valve timing of the intake and exhaust valves 23, 24 are changed, the valve overlap period can be changed to a desired length.

Figure 6:
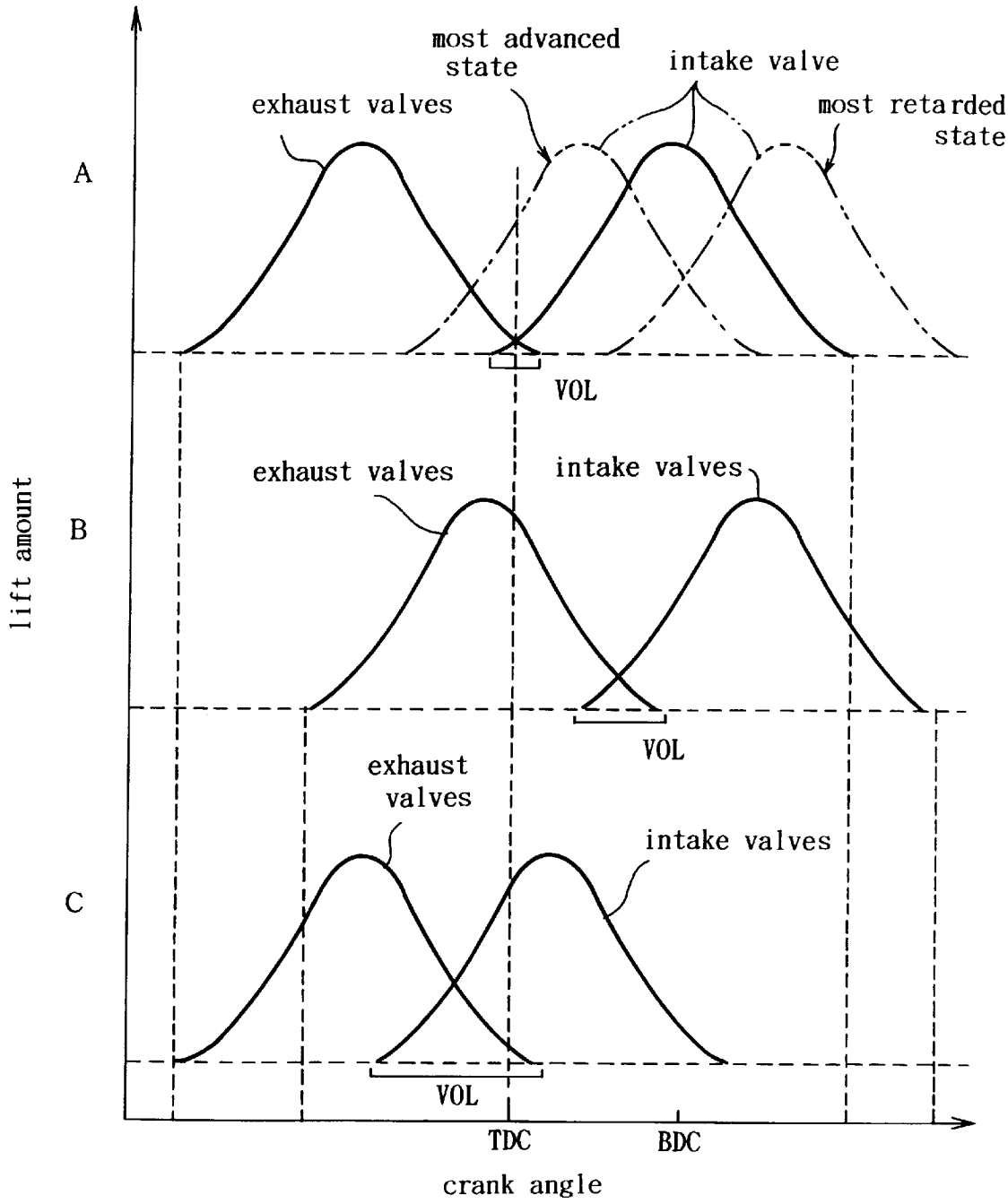
FIG. 6 includes graphs showing valve timings of the intake and exhaust valves in respective driving states.

It is to be noted that the valve overlap period plays an important role in an attempt to improve startability of the engine 10, fuel consumption or output torque. According to this embodiment, the valve timings of the intake and exhaust valves 23, 24 and the valve overlap period are adjusted, whereby the overall characteristics of the engine 10 can be significantly enhanced. The valve timings of the intake and exhaust valves 23, 24 and the valve overlap period will be described hereinafter with reference to FIG. 6. FIG. 6 shows respective changes in lift amount of the intake and exhaust valves 23, 24, in accordance with a change in crank angle.

[1] During engine start and idle driving

During engine start and idle driving, the first and second VVT's 13, 14 are controlled so as to assume the most retarded and advanced states respectively. Accordingly, the valve overlap period VOL is set to its minimum value. Consequently, it is possible to inhibit the occurrence of so-called pre-firing, that is, a phenomenon wherein burned gas remaining in the combustion chamber 20*a* or the exhaust passage returns to the side of the intake passage. Thereby, it becomes possible to ensure good startability of the engine as well as good stability during idle driving.

In addition, the valve timing of the intake valves 23 is set to an intermediate timing between the most advanced timing (where the first and second VVT's 13, 14 both assume the most advanced state) and the most retarded timing (where the first and second VVT's 13, 14 both assume the most retarded state), as indicated by a solid line of graph A in FIG. 6. Therefore, there is no possibility of pre-firing occurring due to an increase in the valve overlap period, unlike the case where the valve timing of the intake valves 23 is set to the most advanced timing. Nor is there any possibility of insufficient compression due to an excessively retarded opening timing of the intake valves 23, unlike the case where the valve timing of the intake valves 23 is set to the most retarded timing. Consequently, it is possible to further enhance startability of the engine while inhibiting a decrease in output torque.

[2] During low-load driving and intermediate-load driving

During low-load driving and intermediate-load driving, the first VVT 13 is controlled so as to assume the most retarded state or a state slightly advanced from the most retarded state, and the second VVT 14 is controlled so as to assume the most retarded state. Hence, as indicated by graph B in FIG. 6, the valve timing of the intake valves 23 is set to the most retarded timing or a timing slightly advanced from the most retarded timing, and the closure timing of the intake valves 23 is set to the most retarded timing. In this case, the valve timing of the intake valves 23 is set to a timing further retarded from the valve timing during engine start and idle driving or the valve timing during high-load driving, which will be described later. Accordingly, the closure timing of the intake valves 23 is retarded, and the intake air that has been temporarily introduced into the combustion chamber 20*a* is returned to the side of the intake passage. Therefore, the opening degree of the throttle valve increases by an amount corresponding to the amount of intake air thus returned, whereby it becomes possible to reduce the amount of pumping loss. Furthermore, because the valve timing of the exhaust valves 24 is set to the most retarded timing, the closure timing thereof is retarded, whereby it becomes possible to increase the actual ratio of expansion. Accordingly, it is possible to improve fuel consumption by reducing the amount of pumping loss and increasing the actual ratio of expansion.

During engine start or idle driving, the first VVT 13 is controlled so as to assume the most retarded state, so that the valve overlap period VOL is set to its minimum value. However, during low-load driving and intermediate-load driving, it is also preferable to increase the valve overlap period VOL to such an extent that the amount of pumping loss is not substantially increased, by slightly advancing the first VVT 13 from the most retarded state. By thus increasing the valve overlap period VOL, the amount of burned gas remaining in the combustion chamber 20*a*, that is, the amount of internal EGR is increased. In this manner, the amount of nitrogen oxide ($NO_x$) contained in exhaust gas is reduced, whereby it becomes possible to achieve an improvement in concentrations of emission substances.

[3] During high-load driving

Furthermore, during high-load driving, the first and second VVT's 13, 14 are both controlled so as to assume the most advanced state. Hence, as indicated by graph C in FIG. 6, the valve timing of the intake valves 23 is set to the most advanced timing. Thus, the opening timing and closure timing of the intake valves 23 are advanced, so that the opening degree of the intake valves 23 can be set to a large value when the piston travels at a high speed (i.e., when the piston is substantially between the intake top dead center TDC and the intake bottom dead center BDC). Consequently, it is possible to achieve an improvement in output torque by enhancing the intake efficiency.

Furthermore, because the first VVT 13 is controlled so as to assume the most advanced state, the valve overlap period VOL is set to its maximum value. Accordingly, it is possible to take advantage of a pulsation effect so as to enhance the intake efficiency and achieve an improvement in output torque.

In order to change a valve overlap period to a length suited for an operational state of the engine 10, it is required that the valve timings of both the intake and exhaust valves 23, 24 coincide with respective target valve timings. However, since there is a limit to the accuracy of valve timing control, the actual valve timings slightly deviate from target valve timings.

For example, if a construction is employed wherein the intake cam shaft 11 is provided with a VVT that only changes a valve timing of the intake valves 23 and the exhaust cam shaft 12 is provided with a VVT that only changes a valve timing of the exhaust valves 24 so that those VVT'S change valve timings of the intake and exhaust valves 23, 24, the difference between the actual and target valve overlap periods may increase due to superposition of control errors of the respective VVT's.

According to this embodiment, even if there is a control error as described above during valve timing control based on the second VVT 14, the control error does not adversely affect the precision in changing a valve overlap period. For, even if the second VVT 14 operates, the valve timings of the intake and exhaust valves 23, 24 are simultaneously changed by an equal phase, so that the valve overlap period is not changed. Therefore, this embodiment makes it possible to inhibit a deterioration in precision in changing a valve overlap period and to bring the valve overlap period much closer to a length that is best suited for an operational state of the engine 10.

In this embodiment, the oil pump 62 is driven in accordance with rotation of the crank shaft 15. Therefore, during engine start wherein the crank shaft 15 rotates at a considerably low speed, the oil discharged from the oil pump 62 is under a low pressure, so that the first and second VVT's 13, 14 tend to encounter difficulties in performing normal operations. Especially, this tendency becomes conspicuous when the engine 10 is restarted after a long period of time has elapsed since initial stoppage of the engine 10. In other words, when the engine 10 is restarted as in this case, oil in the respective pressure chambers 50, 52, 90 and 91 of the first and second VVT's 13, 14 and oil in the respective pressure passages 51, 53, 93 and 94 have been returned to the oil pan 18. Accordingly, the first and second VVT's 13, 14 cannot operate until the respective pressure chambers 50, 52, 90 and 91 and the respective pressure passages 51, 53, 93 and 94 are filled with oil.

The ring gear 33 of the first VVT 13 is constantly urged toward the first pressure chamber 50, due to a driving counterforce applied to the intake cam shaft 11 when it drivingly opens or closes the intake valves 23. On the other hand, the ring gear 72 of the second VVT 14 is constantly urged toward the second pressure chamber 91, due to a driving counterforce applied to the intake and exhaust cam shafts 11, 12 when they drivingly open or close the intake and exhaust valves 23, 24 respectively.

Therefore, during engine start wherein hydraulic pressures in the respective pressure chambers 50, 52, 90 and 91 of the first and second VVT's 13, 14 drop below a predetermined value, the ring gears 33, 72 move in respective directions in which they are urged, thus urging both the first and second VVT's 13, 14 toward the most retarded state.

If the first and second VVT's 13, 14 assume the most retarded state, the engine 10 is started in a state where the valve timing of the intake valves 23 has been changed to the most retarded timing by the first and second VVT's 13, 14. Hence, the most retarded timing of the intake valves 23 needs to be set such that even if the intake valves 23 are opened or closed at the aforementioned most retarded timing, the engine 10 can be started reliably enough to achieve various driving states ranging from idle driving to high-load driving.

For example, if the most retarded timing is set to the optimal timing for engine start, it may become impossible to drive under a high load. On the contrary, if the most retarded timing is set to the optimal timing for high-load driving, it may become impossible to start the engine 10. Hence, the aforementioned most retarded timing can be set only within a limited range, so that the range where the valve timing of the intake valves 23 can be changed is inevitably restricted.

However, according to this embodiment, the second VVT 14 is provided with the return spring 110, so that the second VVT 14 is maintained in the most advanced state in starting the engine 10. For, the return spring 110 urges and forcibly moves the ring gear 72 of the second VVT 14 toward the first pressure chamber 90 until the pressure-receiving portion 72*b* abuts on the crank pulley 39. Accordingly, the second VVT 14 is maintained in the most advanced state, and the first VVT 13 is maintained in the most retarded state as described above. Therefore, the first and second VVT's 13, 14 set a valve timing of the intake valves 23 to an intermediate timing, which is between the most advanced timing and the most retarded timing.

In this manner, according to this embodiment, the valve timing of the intake valves 23 is set to an intermediate timing when the engine 10 is started, that is, when the first and second VVT's 13, 14 do not operate properly. Hence, it is possible to achieve various driving states ranging from idle driving to high-load driving, while ensuring startability of the engine 10 to a predetermined degree. When the first and second VVT 13, 14 can operate, the valve timing of the intake valves 23 is further advanced or retarded so as to be set to the timing that is better suited for an operational state of the engine 10. Consequently, this embodiment eliminates the necessity to set the most retarded timing of the intake valves 23 in consideration of the case where the first and second VVT's 13, 14 do not operate properly. Thereby, it becomes possible to widen the range where the valve timing of the intake valves 23 can be changed.

In addition, according to this embodiment, even if the first and second VVT's 13, 14 are incapable of operation in starting the engine 10, they are maintained in the most retarded and advanced states respectively. Thus, the valve overlap period is set to its minimum length. As a result, this embodiment can reliably inhibit the occurrence of pre-firing and improve startability of the engine.

According to this embodiment which has been described hitherto, it is possible to ensure good startability of the engine as well as good stability during idle driving. Further, during low-load driving and intermediate-load driving, it is possible to improve fuel consumption by reducing the amount of pumping loss and increasing the actual ratio of expansion and to achieve an improvement in concentrations of emission substances. Still further, during high-load driving, it is possible to achieve an improvement in output torque by enhancing the intake efficiency.

Also, this embodiment can inhibit a deterioration in precision in changing a valve overlap period.

Further, this embodiment makes it possible to widen the range where the valve timing of the intake valves 23 can be changed.

Still further, this embodiment can ensure good startability of the engine even if the first and second VVT's 13, 14 are incapable of operation.

[Second Embodiment]

A second embodiment of the present invention will be described hereinafter with reference to FIGS. 7 through 10. In the first and second embodiments, like components are denoted by like reference numerals, and the description of those components which function substantially in the same manner as those of the first embodiment will be omitted below.

As is the case with the first embodiment, this embodiment also has a construction wherein the intake cam shaft 11 is provided with a first VVT 120 and the crank shaft 15 is provided with a second VVT 121. Although the first embodiment employs the timing belt for transmitting a torque of the crank shaft 15 to the intake and exhaust cam shafts 11, 12, this embodiment substitutes a timing chain for the timing belt. In addition, this embodiment is different from the first embodiment in that both the first and second VVT's 120, 121 are of a rotary type.

Figure 7:
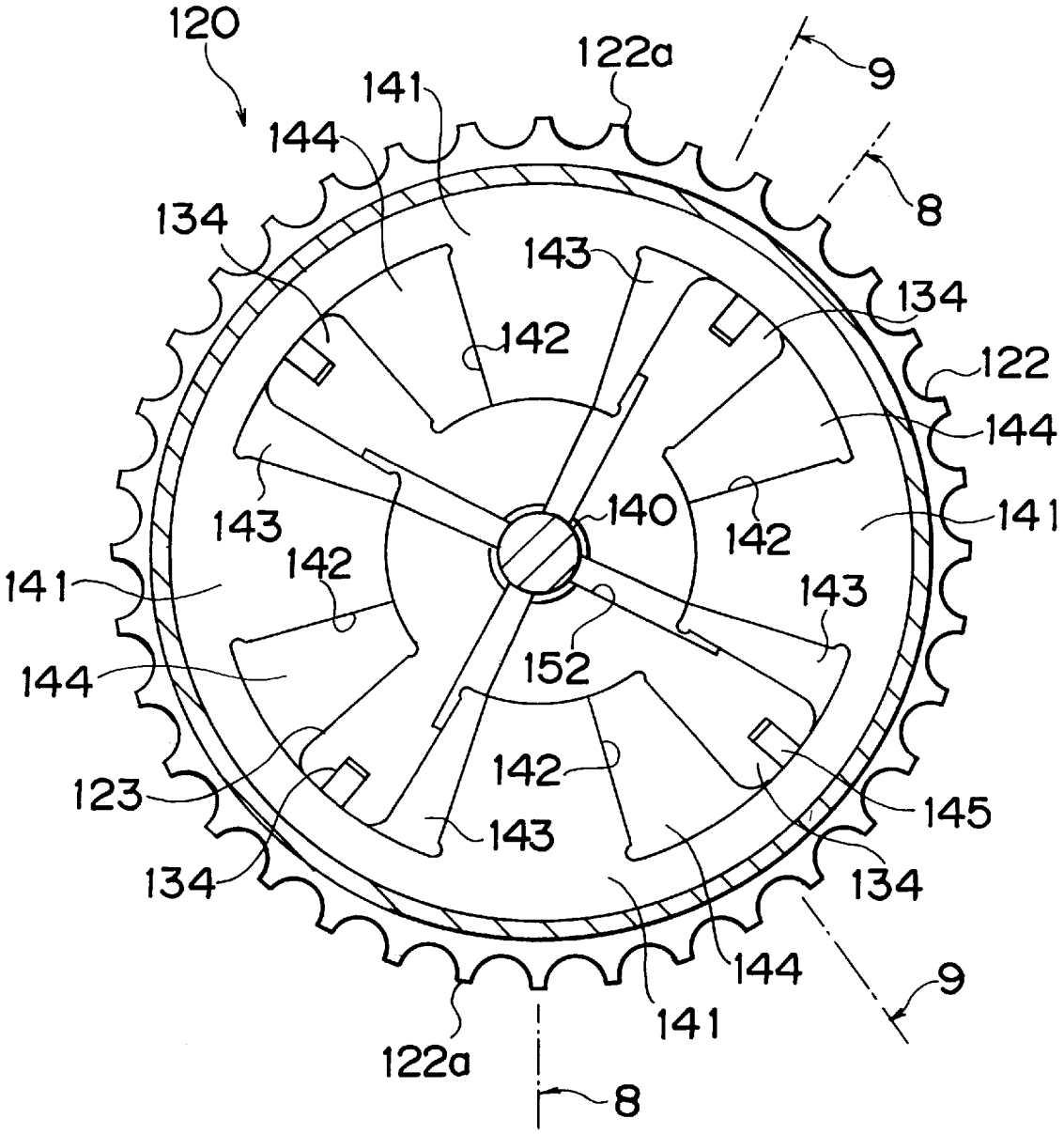
FIG. 7 is a sectional view of a first VVT according to a second embodiment of the present invention.
Figure 8:
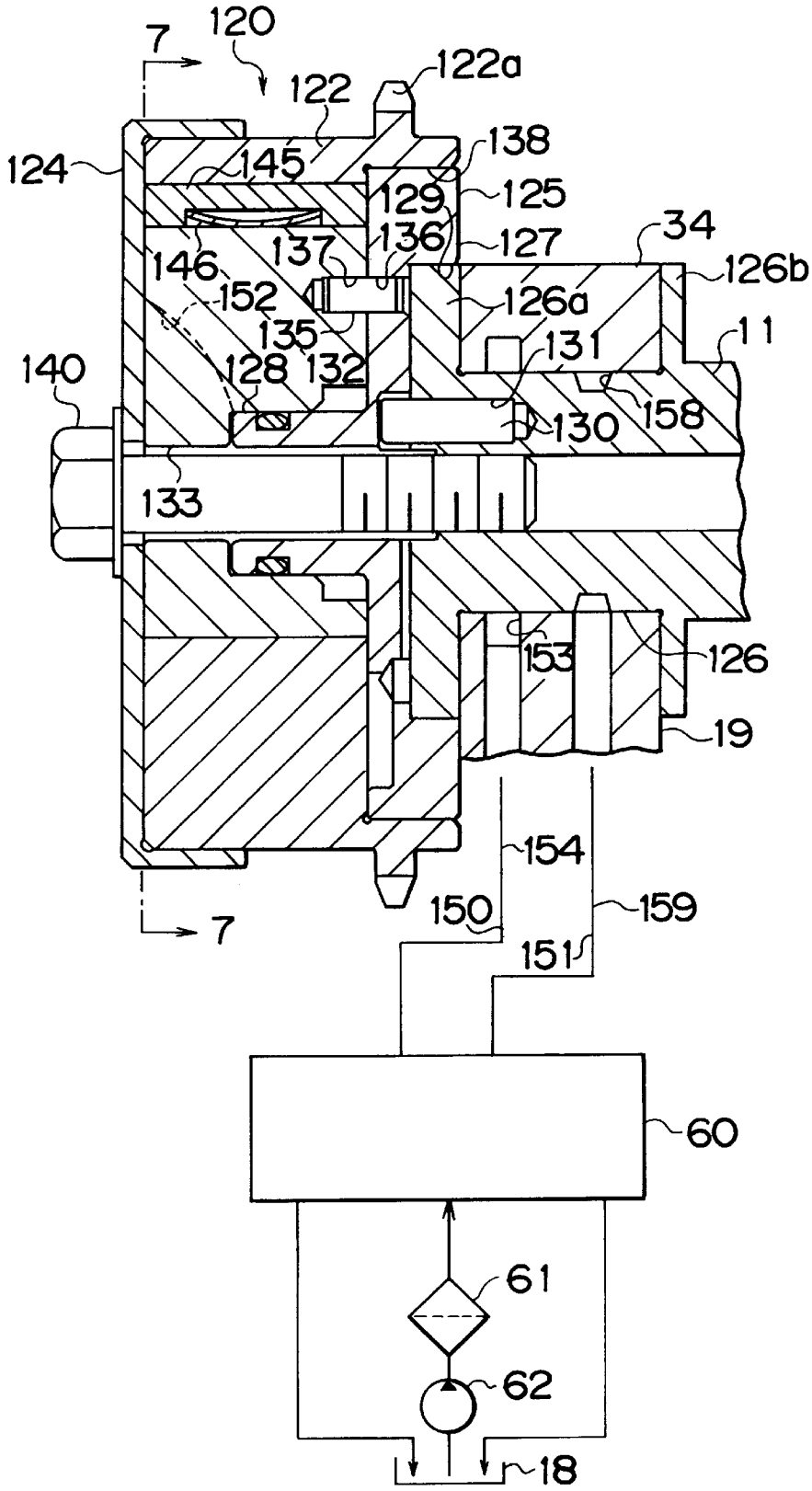
FIG. 8 is a sectional view taken along line 8—8 in FIG. 7.
Figure 9:
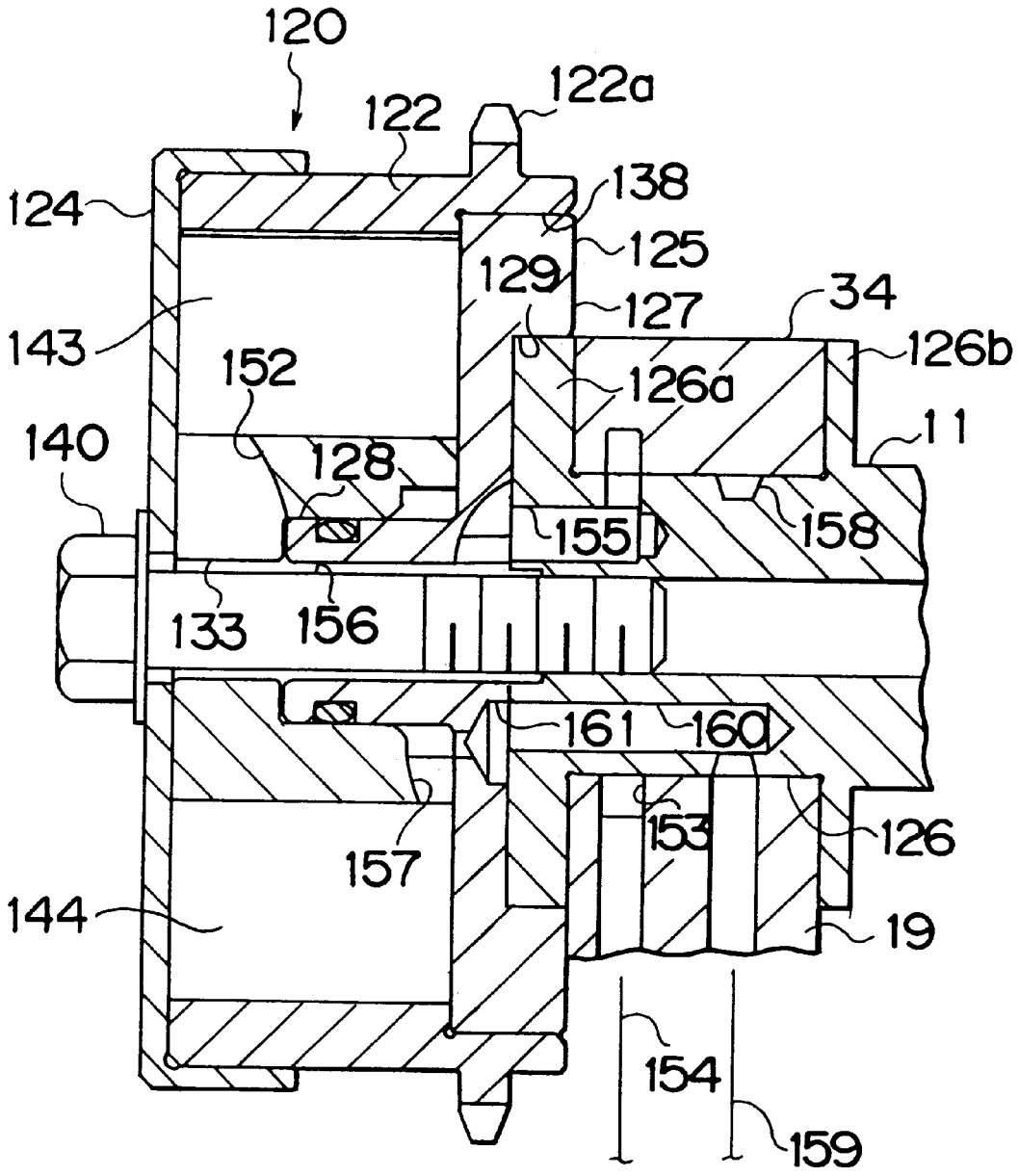
FIG. 9 is a sectional view taken along line 9—9 in FIG. 7.

FIGS. 7 through 9 illustrate the first VVT 120 mounted to the intake cam shaft 11. FIG. 8 is a sectional view taken along line 8—8 in FIG. 7. FIG. 9 is a sectional view taken along line 9—9 in FIG. 7. FIG. 7 is a sectional view taken along line 7—7 in FIG. 8.

As shown in FIGS. 7 through 9, the first VVT 120 is provided with a cam sprocket 122, a rotor 123, a front cover 124, a rear plate 125 and the like.

The intake cam shaft 11 has a plurality of journals 126 (only one of them is shown), and the journal 126 located on the front end side of the intake cam shaft 11 is provided with a pair of flanges 126*a*, 126*b*. The cylinder head 19 and the bearing cap 34 rotatably support the intake cam shaft 11 between the flanges 126*a*, 126*b*.

The rear plate 125 has a disc portion 127 and a boss 128, and receives the flange 126*a* on the front end side in a recess 129 formed in the disc portion 127. An engagement pin 130 is implanted in a pin hole 131 formed in the flange 126*a* so as to protrude toward the front end side, and is in engagement with a pin hole 132 formed in the disc portion 127. Accordingly, the rear plate 125 rotates integrally with the intake cam shaft 11.

A stepped through hole 133 extends through the axial center of the rotor 123. Furthermore, four radially protruding vanes 134 are formed along the outer circumference of the rotor 123 at equal angular intervals. The through hole 133 of the rotor 123 receives the boss 128 of the rear plate 125. An engagement pin 135 (although a plurality of engagement pins 135 are provided, only one of them is shown) is implanted in a pin hole 136 formed in the disc portion 127 of the rear plate 125 so as to protrude toward the front end side, and is in engagement with a pin hole 137 of the vane 134. Accordingly, the rotor 123 rotates integrally with the rear plate 125 and the intake cam shaft 11.

The cam sprocket 122 is substantially in the shape of a cylinder and is disposed on the outer circumference of the disc portion 127 of the rear plate 125 and the rotor 123. The cam sprocket 122 has recesses 138 in the shape corresponding to the outer diameter of the disc portion 127, and is supported at the recesses 138 so as to rotate relative to the disc portion 127 along the outer circumference thereof. By receiving a torque from the crank shaft (not shown) via the timing chain (not shown), the cam sprocket 122 rotates clockwise in FIG. 7.

The front cover 124, which covers front faces of the cam sprocket 122 and the rotor 123, is fitted onto the outer circumference of the cam sprocket 122 so as to rotate relative thereto. The front cover 124 is fixed to the front end portion of the intake cam shaft 11 by means of a bolt 140. Thus, the front cover 124, the rotor 123, the rear plate 125 and the intake cam shaft 11 can rotate altogether.

A plurality of teeth 122*a* are formed along the outer circumference of the cam sprocket 122 in such a manner as to correspond to the recesses 138. The number of the teeth 122*a* coincides with the number of the recesses 138. The timing chain is hung on the outer circumference of the teeth 122*a*. This timing chain is also hung on a later-described crank sprocket 170 and a cam sprocket (not shown) that is mounted to the front end portion of the exhaust cam shaft (not shown).

Four protrusions 141 protruding toward the center are formed along the inner circumference of the cam sprocket 122 at equal angular intervals. Formed among the protrusions 141 are four recesses 142 for accommodating the vanes 134 of the rotor 123 and a space for accommodating the cylindrical portion of the rotor 123. Each of the vanes 134 is disposed in a corresponding one of the recesses 142, so that first and second pressure chambers 143, 144 are formed on opposed sides of each of the vanes 134.

A sealing member 145 is attached to the outer end face of each of the vanes 134 and is press-fitted onto the inner wall surface of each of the recesses 142 by a leaf spring 146. Thus, the sealing member 145 seals the first and second pressure chambers 143, 144, so that oil is prevented from moving between the first and second pressure chambers 143, 144. Consequently, in a state where oil has been supplied to the first and second pressure chambers 143, 144, the rotor 123 is coupled to the cam sprocket 122 due to an oil pressure, which transmits rotation of the cam sprocket 122 to the rotor 123. Thus, the intake cam shaft 11 rotates together with the rotor 123.

First and second pressure passages 150, 151 for supplying oil to the first and second pressure chambers 143, 144 respectively will now be described.

As shown in FIGS. 7 through 9, a cross-like passage 152 leading to the respective first pressure chambers 143 is formed in the front face of the rotor 123. On the other hand, an annular groove 153 is formed in the inner circumferences of the cylinder head 19 and the bearing cap 34, along the outer circumference of the journal 126. As shown in FIG. 8, the groove 153 is connected to the oil pump 62, via the first OCV 60 and a passage 154 that is formed in the cylinder head 19 or the like.

A substantially L-shaped connection passage 155 is formed inside the journal 126. An annular gap 156 is formed between the boss 128 and the bolt 140. The groove 153 is connected to the first pressure chamber 143 by the connection passage 155, the gap 156 and the cross-like passage 152. Accordingly, oil that has been supplied from the oil pump 62 to the passage 154 via the first OCV 60 is supplied to the first pressure chamber 143 via the groove 153, the connection passage 155, the gap 156 and the cross-like passage 152. The passage 154, the groove 153, the connection passage 155, the gap 156 and the cross-like passage 152 constitute the first pressure passage 150.

On the other hand, a cross-like passage 157, which is substantially in the same shape as the cross-like passage 152 and leads to the respective second pressure chambers 144, is formed in the rear face of the rotor 123. An annular groove 158 is formed along the outer circumference of the journal 126, and the groove 158 is connected to the oil pump 62, via the first OCV 60 and a passage 159 that is formed in the cylinder head 19 or the like.

A connection passage 160, which extends parallel to the axis of the intake cam shaft 11, is formed inside the journal 126. An intermediate passage 161 is formed in the rear plate 125 so as to allow communication between the connection passage 160 and the cross-like passage 157. Accordingly, oil that has been supplied from the oil pump 62 to the passage 159 via the first OCV 60 is supplied to the second pressure chamber 144 via the groove 158, the connection passage 169, the intermediate passage 161 and the cross-like passage 157. The passage 159, the groove 158, the connection passage 160, the intermediate passage 161 and the cross-like passage 157 constitute a second pressure passage 151.

As is the case with the first embodiment, by being subjected to duty control by the electronic control unit of the engine 10, the first OCV 60 selectively supplies oil to or discharge oil from the pressure chambers 143, 144 through the first and second pressure passages 150, 151 respectively.

For example, due to the operation of the first OCV 60, oil is supplied to the first pressure chamber 143 through the first pressure passage 150, and oil in the second pressure chamber 144 is returned to the oil pan 18 through the second pressure passage 151. Thereby, the hydraulic pressure in the first pressure chamber 143 becomes higher than that in the second pressure chamber 144. Consequently, the rotor 123 receives a torque acting clockwise in FIG. 7. As a result, the rotor 123 rotates together with the intake cam shaft 11 relative to the cam sprocket 122, in the same direction as the cam sprocket 122 rotates. Due to rotation of the intake cam shaft 11 relative to the cam sprocket 122, the rotational phase of the intake cam shaft 11 relative to the cam sprocket 122 is changed, so that the valve timing of the intake valves (not shown) is advanced as compared with the current valve timing thereof.

If, as described above, each of the vanes 134 moves toward the second pressure chamber 144 based on rotation of the rotor 123 relative to the cam sprocket 122, the rotor 123 finally stops at a position where a lateral face of each of the vanes 134 abuts on the protrusion 141. In this state, the valve timing of the intake valves 23 is most advanced by the first VVT 120 (it is to be noted herein that the first VVT 120 assumes a most advanced state).

On the other hand, due to the operation of the first OCV 60, oil is supplied to the second pressure chamber 144 through the second pressure passage 151, and oil in the first pressure chamber 143 is returned to the oil pan 18 through the first pressure passage 150. Thereby, the hydraulic pressure in the second pressure chamber 144 becomes higher than that in the first pressure chamber 143. Consequently, the rotor 123 receives a torque acting counterclockwise in FIG. 7. As a result, the rotor 123 rotates together with the intake cam shaft 11 relative to the cam sprocket 122, in the direction opposite to the rotational direction of the cam sprocket 122. Due to rotation of the intake cam shaft 11 relative to the cam sprocket 122, the rotational phase of the intake cam shaft 11 relative to the cam sprocket 122 is changed, so that the valve timing of the intake valves (not shown) is retarded as compared with the current valve timing thereof.

If, as described above, each of the vanes 134 moves toward the first pressure chamber 143 based on rotation of the rotor 123 relative to the cam sprocket 122, the rotor 123 finally stops at a position where a lateral face of each of the vanes 134 abuts on the protrusion 141. In this state, the valve timing of the intake valves is most retarded by the first VVT 120 (it is to be noted herein that the first VVT 120 assumes a most retarded state).

On the other hand, due to the operation of the first OCV 60, oil is stopped from being supplied to or discharged from the pressure chambers 143, 144, whereby internal volumes of the pressure chambers 143, 144 are determined. As a result, the respective vanes 134 stop moving and the valve timing of the intake valves is maintained as it is.

By thus operating the first VVT 120, it is possible to continuously retard or advance a valve timing of the intake valves so as to maintain it at a desired timing.

The second VVT 121 will now be described. Because the second VVT 121 has substantially the same construction as the first VVT 120, the following description will concentrate on differences between the first and second VVT's 120, 121.

Figure 10:
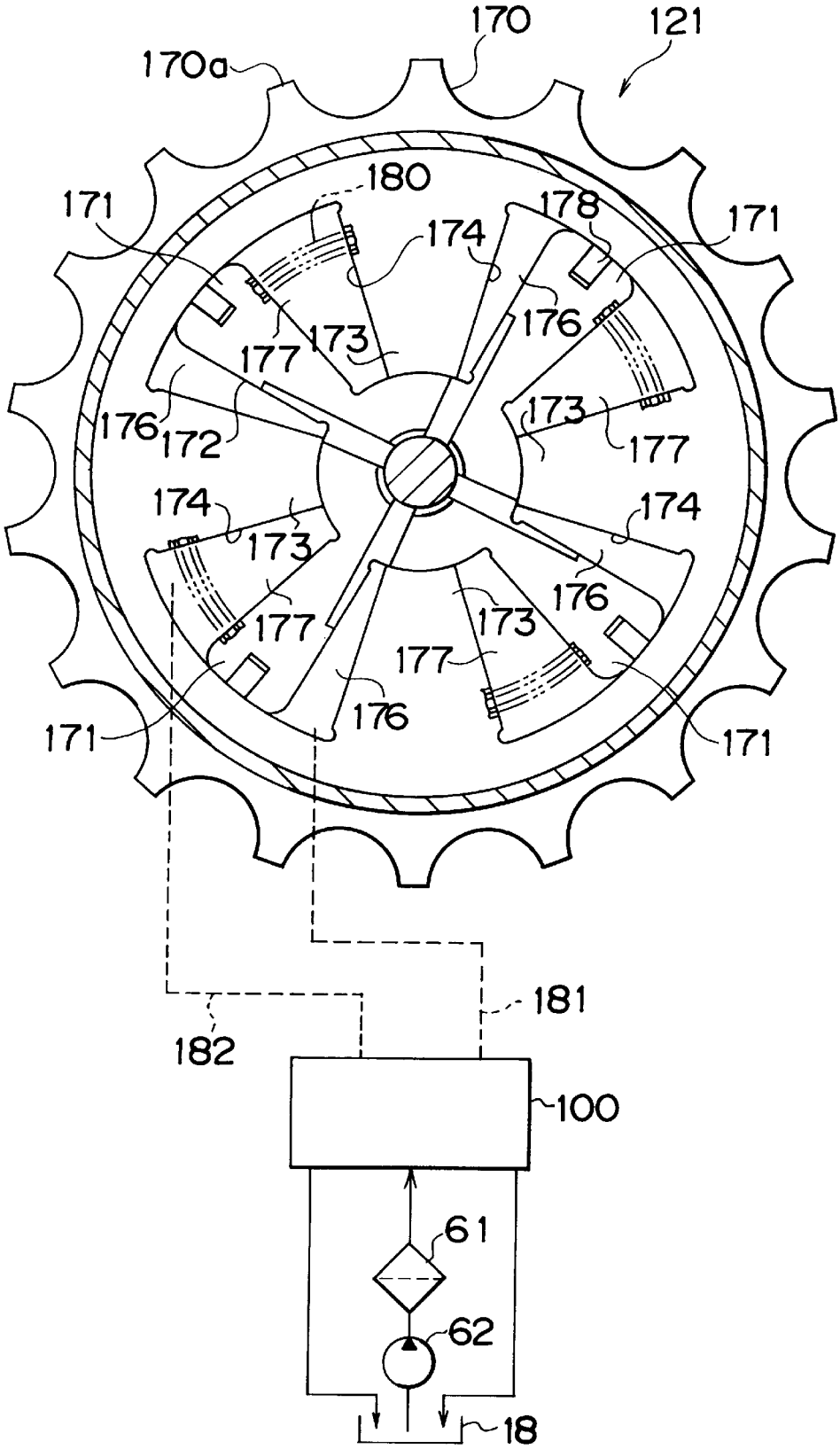
FIG. 10 is a sectional view of a second VVT according to the second embodiment of the present invention.

FIG. 10 is an enlarged view of the second VVT 121, which is provided with a crank sprocket 170 and a rotor 172 having a plurality of vanes 171.

As is the case with the first VVT 120, the crank sprocket 170 is mounted to the front end portion of the crank shaft (not shown) so as to rotate relative thereto. A plurality of teeth 170*a* are formed along the outer circumference of the crank sprocket 170, and a timing chain is hung on the teeth 170*a*. Further, four protrusions 173 protruding toward the center are formed along the inner circumference of the crank sprocket 170 at equal angular intervals. Formed among the protrusions 173 are four recesses 174 for accommodating the vanes 171 of the rotor 172 and a space for accommodating the cylindrical portion of the rotor 172. Each of the vanes 171 is disposed in a corresponding one of the recesses 174, so that first and second pressure chambers 176, 177 are formed on opposed sides of each of the vanes 171.

A sealing member 178 is attached to the outer end face of each of the vanes 171, and is press-fitted onto the inner wall surface of each of the recesses 174 by a leaf spring (not shown). Thus, the sealing member 178 seals the first and second pressure chambers 176, 177, so that oil is prevented from moving between the first and second pressure chambers 176, 177. Consequently, in a state where oil has been supplied to the first and second pressure chambers 176, 177, the rotor 172 is coupled to the crank sprocket 170 due to an oil pressure, which transmits a torque of the crank shaft from the rotor 172 to the crank sprocket 170. The torque thus transmitted to the crank sprocket 170 is transmitted to the intake cam shaft 11 and the exhaust cam shaft via the timing chain.

A return spring 180 serving as advancing means is provided in each of the second pressure chambers 177. The return spring 180 is fixed at one end to a lateral face of each of the vanes 171 on the side of the second pressure chamber 177, and is fixed at the other end to a lateral face of each of the protrusions 173 on the side of the second pressure chamber 177. The return spring 180 urges each of the protrusions 173 toward the first pressure chamber 176, so that the crank sprocket 170 constantly receives a torque acting clockwise in FIG. 10.

The first and second pressure chambers 176, 177 are connected to the second OCV 100 by passages 181, 182 respectively, which have substantially the same construction as the first and second pressure passages 150, 151. As described in reference to the first embodiment, by being subjected to duty control by the electronic control unit, the second OCV 100 selectively supplies oil to or discharge oil from the pressure chambers 176, 177 through the first and second pressure passages 181, 182 respectively.

For example, due to the operation of the second OCV 100, oil is supplied to the first pressure chamber 176 through the first pressure passage 181, and oil in the second pressure chamber 177 is returned to the oil pan 18 through the second pressure passage 182. Thereby, the urging force applied to each of the protrusions 173 based on a hydraulic pressure in the first pressure chamber 176 becomes greater than a resultant force of the urging force that is applied to each of the protrusions 173 based on a hydraulic pressure in the second pressure chamber 177 and the urging force that is applied to each of the protrusions 173 by the return spring 180. Consequently, the crank sprocket 170 receives a torque acting counterclockwise in FIG. 10.

As a result, the crank sprocket 170 rotates relative to the crank shaft and the rotor 172 in the direction opposite to the rotational direction thereof. Due to rotation of the crank sprocket 170 relative to the crank shaft and the rotor 172, rotational phases of the intake cam shaft 11 and the exhaust cam shaft are simultaneously changed by an equal amount, whereby the valve timings of both the intake and exhaust valves are retarded as compared with the current valve timings thereof.

If, as described above, each of the protrusions 173 moves toward the second pressure chamber 177 based on rotation of the crank sprocket 170 relative to the crank shaft, the crank sprocket 170 finally stops at a position where the return spring 180 assumes its minimum length. In this state, the valve timings of the intake and exhaust valves are most retarded by the second VVT 121 (it is to be noted herein that the second VVT 121 assumes a most retarded state).

On the other hand, due to the operation of the second OCV 100, oil is supplied to the second pressure chamber 177 through the second pressure passage 182, and oil in the first pressure chamber 176 is returned to the oil pan 18 through the first pressure passage 181. Thereby, the resultant force of the urging force that is applied to each of the protrusions 173 based on a hydraulic pressure in the second pressure chamber 177 and the urging force that is applied to each of the protrusions 173 by the return spring 180 becomes greater than the urging force that is applied to each of the protrusions 173 based on a hydraulic pressure in the first pressure chamber 176. Consequently, the crank sprocket 170 receives a torque acting clockwise in FIG. 10.

As a result, the crank sprocket 170 rotates relative to the crank shaft and the rotor 172 in the same direction as they rotate. Due to rotation of the crank sprocket 170 relative to the crank shaft and the rotor 172, rotational phases of the intake cam shaft 11 and the exhaust cam shaft are simultaneously changed by an equal amount, whereby the valve timings of both the intake and exhaust valves are advanced as compared with the current valve timings thereof.

If, as described above, each of the protrusions 173 moves toward the first pressure chamber 176 based on rotation of the crank sprocket 170 relative to the crank shaft, the crank sprocket 170 finally stops at a position where the lateral face of each of the protrusions 173 abuts on each of the vanes 171. In this state, the valve timings of the intake and exhaust valves are most advanced by the second VVT 121 (it is to be noted herein that the second VVT 121 assumes a most advanced state).

On the other hand, due to the operation of the second OCV 100, oil is stopped from being supplied to or discharged from the pressure chambers 176, 177, whereby internal volumes of the pressure chambers 176, 177 are determined. As a result, the crank sprocket 170 stops rotating relative to the crank shaft, and the valve timings of the intake and exhaust valves are maintained as they are.

By thus operating the second VVT 121, it is possible to continuously retard or advance valve timings of the intake and exhaust valves so as to maintain them at desired timings.

As is the case with the first embodiment, according to this embodiment, the first and second VVT's 120, 121 are operated as described above, so that the valve timings of the intake and exhaust valves can be changed to timings that are suited for an operational state of the engine 10 and maintained at those timings. Also, according to this embodiment, while the valve timings of the intake and exhaust valves are changed, the valve overlap period can be changed to a desired length.

Furthermore, as is the case with the second VVT 14 of the first embodiment, the second VVT 121 of this embodiment is designed to simultaneously change valve timings of the intake and exhaust valves by an equal phase. Therefore, even if there is a control error during valve timing control based on the second VVT 121, the control error does not adversely affect the precision in changing a valve overlap period. Consequently, this embodiment also makes it possible to inhibit a deterioration in precision in changing a valve overlap period.

Further, when the engine 10 is started, that is, when hydraulic pressures in the respective pressure chambers 143, 144, 176 and 177 of the first and second VVT's 120, 121 drop below a predetermined value to such an extent that the first and second VVT's 120, 121 cannot operate properly, the first and second VVT's 120, 121 are maintained in most retarded and advanced states respectively. In other words, the first VVT 120 is unable to prevent relative rotation of the rotor 123 by means of hydraulic pressures in the first and second pressure chambers 143, 144. Therefore, the rotor 123 rotates relative to the cam sprocket 122 until each of the vanes 134 moves toward the first pressure chamber 143 and abuts on each of the protrusions 141, due to a driving counterforce applied to the intake cam shaft 11 when it drivingly opens or closes the intake valves 23. Due to rotation of the rotor 123 relative to the cam sprocket 122, the first VVT 120 assumes the most retarded state.

On the other hand, the second VVT 121 is designed such that the return spring applies an urging force to each of the protrusions 173 of the crank sprocket 170 and that the crank sprocket 170 is thereby caused to rotate relative to the crank shaft and the rotor 172 until each of the protrusions 173 abuts on each of the vanes 171. As a result, the second VVT 121 assumes the most advanced state.

As described hitherto, when the engine 10 is started, the first and second VVT's 120, 121 are maintained in the most retarded and advanced states respectively. Therefore, as is the case with the first embodiment, this embodiment also makes it possible to widen the range where the valve timing of the intake valves can be changed and to improve startability of the engine 10.

[Third Embodiment]

A third embodiment of the present invention will be described hereinafter with reference to FIG. 11. In the first and third embodiments, like components are denoted by like reference numerals, and the description of those components which function substantially in the same manner as those of the first embodiment will be omitted below.

Figure 11:
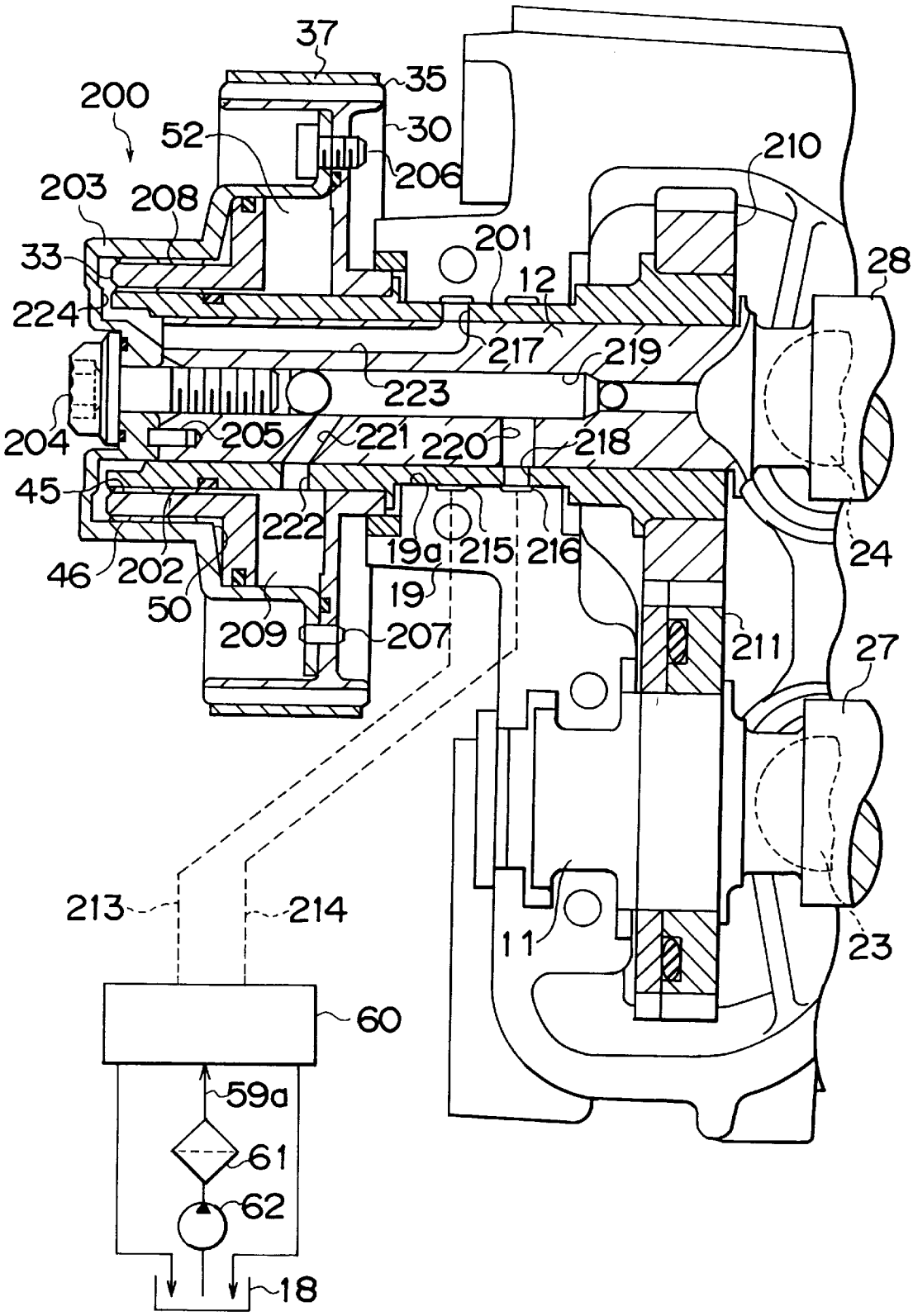
FIG. 11 is a sectional view of a first VVT and the like according to a third embodiment of the present invention.

FIG. 11 is a sectional view showing the intake cam shaft 11, the exhaust cam shaft 12 and a first VVT 200 that is mounted to the front end of the exhaust cam shaft 12.

A sleeve 201 is fitted onto the outer circumference of the exhaust cam shaft 12 on the front end side (on the left side in FIG. 11) so as to rotate relative to the exhaust cam shaft 12. The sleeve 201 is rotatably supported by a bearing 19*a* of the cylinder head 19 and the bearing cap (not shown). A plurality of outer teeth 202 are formed along the outer circumference of the sleeve 201 on its front end side. The outer teeth 202 are helical teeth that are inclined with respect to the axis of the exhaust cam shaft 12.

A cam pulley 30 is fitted onto the outer circumference of the sleeve 201 on its front end side so as to rotate relative to the sleeve 201. The timing belt 37 is hung on the outer teeth 35 formed along the outer circumference of the cam pulley 30. As is the case with the first embodiment, the crank shaft (see FIG. 1) is provided with the second VVT 14 (see FIG. 1), and the timing belt 37 is hung on the crank pulley 39 of the second VVT 14. This embodiment is different from the first embodiment in that the timing belt 37 is hung only on the cam pulley 30 of the first VVT 200 and the cam pulley 39 of the second VVT 14.

A drive gear 210 is fixed to the outer circumference of the sleeve 201 on its base end side. The drive gear 210 is fixed to the outer circumference of the intake cam shaft 11 on its front end side and is in engagement with a driven gear 211, which is constructed like scissors so as to reduce back-lash between the driven gear 211 and the drive gear 210 and to thereby reduce engagement noise.

A cover 203 is attached to the front end portion of the exhaust cam shaft 12 by means of a bolt 204. The cover 203 is substantially in the shape of a cylinder with a closed bottom and is unmovably fixed to the exhaust cam shaft 12 by a pin 205. Furthermore, the cover 203 is fixed to the cam pulley 30 by means of a plurality of bolts 206 and pins 207. Therefore, the cam pulley 30 and the cover 203 rotate integrally with the exhaust cam shaft 12. A plurality of inner teeth 208 are formed along the inner circumference of the cover 203 on its front end side.

As is the case with the first embodiment, the ring gear 33 that is composed of the gear portion 33*a* and the pressure-receiving portion 33*b* is disposed in an annular space 209, which is defined by the sleeve 201, the cover 203 and the cam pulley 30. The inner and outer teeth 45, 46 are formed along the inner and outer circumferences of the gear portion 33*a* respectively. The inner and outer teeth 45, 46 are helical teeth. The inner teeth 45 engage the outer teeth 202 of the sleeve 201, and the outer teeth 46 engage the inner teeth 208 of the cover 203. Accordingly, the torque that has been transmitted from the crank shaft 15 to the cam pulley 30 via the timing belt 37 is transmitted to the ring gear 33 and the sleeve 201. The torque thus transmitted to the ring gear 33 and the sleeve 201 is further transmitted to the intake cam shaft 11, via the driver gear 210 and the driven gear 211.

As is the case with the first embodiment, the ring gear 33 divides the annular space 209 into the first and second pressure chambers 50, 52.

First and second pressure passages 213, 214 for supplying oil to the first and second pressure chambers 50, 52 will now be described.

A pair of annular circumferential grooves 215, 216 are formed along the outer circumference of each of the aforementioned bearing cap and the bearing 19*a* of the cylinder head 19 (FIG. 11 shows only the circumferential grooves 215, 216 that are formed in the bearing 19*a*). A pair of long holes 217, 218 are formed in the sleeve 201. The long holes 217, 218 have a predetermined length along the circumference of the sleeve 201. The long holes 217, 218 are connected to the circumferential grooves 215, 216 respectively.

Formed inside the exhaust cam shaft 12 is an inner passage 223, which extends in the axial direction thereof. The inner passage 223 is connected at its base end side portion to one of the long holes 217, and is connected at its front end side portion to the first pressure chamber 50 via a space 224, which is formed between the cover 203 on one hand and the exhaust cam shaft 12 and the front end portion of the sleeve 201 on the other hand. The circumferential groove 215, the long hole 217, the inner passage 223 and the space 224 constitute the first pressure passage 213.

Formed inside the exhaust cam shaft 12 are another inner passage 219 extending parallel to the inner passage 223 and a hole 220 extending in the radial direction of the exhaust cam shaft 12. The inner passage 219 communicates at its base end side with one of the long holes 218 through the hole 220. Also, the inner passage 219 communicates at its front end side with the second pressure chamber 52 through a hole 221 that is formed inside the exhaust cam shaft 12 and a long hole 222 that is formed in the sleeve 201. The long hole 222 has a predetermined length in the circumferential direction of the sleeve 201. The circumferential groove 216, the long hole 218, the hole 220, the inner passage 219, the hole 221 and the long hole 222 constitute the second pressure passage 214.

As is the case with the first and second pressure passages 51, 53 of the first embodiment, the first and second pressure passages 213, 214 are connected to the first OCV 60. By being subjected to duty control by the electronic control unit, the first OCV 60 selectively supplies oil to or discharge oil from the pressure chambers 50, 52 through the first and second pressure passages 213, 214 respectively.

For example, due to the operation of the first OCV 60, oil is supplied to the first pressure chamber 50 through the first pressure passage 213, and oil in the second pressure chamber 52 is returned to the oil pan 18 through the second pressure passage 214. This results in an increase in hydraulic pressure in the first pressure chamber 50 and a decrease in hydraulic pressure in the second pressure chamber 52. Consequently, the ring gear 33 moves toward the second pressure chamber 52 while rotating upon the axis of the exhaust cam shaft 12, due to an urging force based on the hydraulic pressure in the first pressure chamber 50.

Due to such movement of the ring gear 33, the sleeve 201 receives a torque which causes the sleeve 201 to rotate relative to the cam pulley 30, so that the sleeve 201 and the drive gear 210 rotate relative to the cam pulley 30. In addition, the driven gear 211 is in engagement with the drive gear 210 and rotates relative thereto, whereby the rotational phase of the intake cam shaft 11 is changed. Consequently, the valve timing of the intake valves 23 is advanced as compared with the current valve timing thereof.

On the other hand, due to the operation of the first OCV 60, oil is supplied to the second pressure chamber 52 through the second pressure passage 214, and oil in the first pressure chamber 50 is returned to the oil pan 18 through the first pressure passage 213. This results in an increase in hydraulic pressure in the second pressure chamber 52 and a decrease in hydraulic pressure in the first pressure chamber 50. Consequently, the ring gear 33 moves toward the first pressure chamber 50 while rotating upon the axis of the exhaust cam shaft 12, due to a hydraulic pressure in the second pressure chamber 52.

Due to such movement of the ring gear 33, the sleeve 201 rotates relative to the cam pulley 30 in the direction opposite to the case where the valve timing of the intake valves 23 is advanced. As a result, the valve timing of the intake valves 23 is retarded as compared with the current valve timing thereof.

By thus operating the first VVT 200, it is possible to continuously retard or advance a valve timing of the intake valves 23 so as to maintain it at a desired timing.

On the other hand, as is the case with the first embodiment, the second VVT 14 operates so as to cause the crank pulley 39 to rotate relative to the crank shaft 15, so that the valve timings of both the intake and exhaust valves 23, 24 are simultaneously changed by an equal phase.

As is the case with the first embodiment, this embodiment is also designed such that the valve overlap period is not changed due to the operation of the second VVT 14. Therefore, this embodiment makes it possible to inhibit a deterioration in precision in changing a valve overlap period.

Furthermore, when the engine 10 is started, that is, when oil having a predetermined pressure is not supplied to the first and second VVT's 200, 14, they are maintained in the most retarded and advanced states respectively. Thus, as is the case with the first embodiment, this embodiment also makes it possible to widen the range where the valve timing of the intake valves 23 can be changed and to improve startability of the engine 10.

Furthermore, this embodiment employs the drive and driven gears 210, 211 so that the intake cam shaft 11 is gear-driven by the exhaust cam shaft 12. Accordingly, this embodiment eliminates the necessity to mount a comparatively bulky member such as a cam pulley or the like to the end of the intake cam shaft 11, and achieves a size reduction of the engine 10.

[Fourth Embodiment]

A fourth embodiment of the present invention will be described hereinafter with reference to FIG. 12. In the first and fourth embodiments, like components are denoted by like reference numerals, and the description of those components which function substantially in the same manner as those of the first embodiment will be omitted below. As is the case with the first embodiment, the crank shaft 15 of this embodiment is provided with the second VVT 14, which simultaneously changes valve timings of the intake and exhaust valves 23, 24 by an equal phase.

Figure 12:
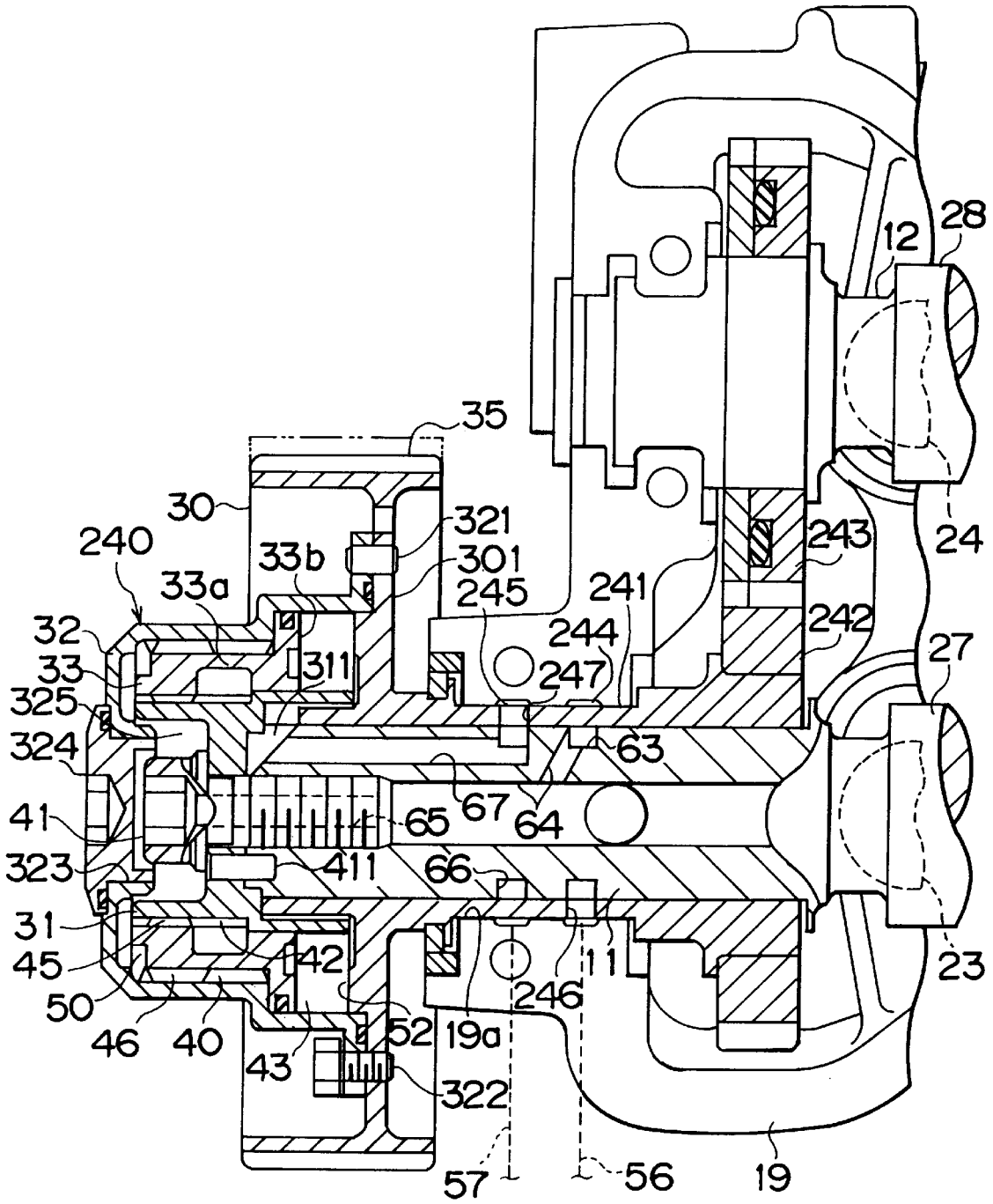
FIG. 12 is a sectional view of a first VVT and the like according to a fourth embodiment of the present invention.

FIG. 12 is a sectional view showing the intake cam shaft 11, the exhaust cam shaft 12, and a first VVT 240 that is mounted to the front end of the intake cam shaft 11.

As shown in FIG. 12, the cam pulley 30 of this embodiment is composed of the disc portion 301 and a sleeve 241 located at the center thereof. The sleeve 241 is fitted onto the outer circumference of the intake cam shaft 11 on its front end side so as to rotate relative to the intake cam shaft 11.

The sleeve 241 is rotatably supported by the bearing cap (not shown) and the bearing 19*a* of the cylinder head 19. A drive gear 242 is fixed to the outer circumference of the sleeve 241 on its base end side. The drive gear 242 is in engagement with a driven gear 243, which is fixed to the outer circumference of the exhaust cam shaft 12 on its front end side. That is, this embodiment is designed to transmit rotation of the crank shaft 15 to the cam pulley 30 via the timing belt 37. The rotation thus transmitted to the crank pulley 30 is further transmitted from the sleeve 241 to the exhaust cam shaft 12 via the drive gear 242 and the driven gear 243.

A pair of annular circumferential grooves 244, 245 are formed along the outer circumference of each of the aforementioned bearing cap and the bearing 19*a* of the cylinder head 19 (FIG. 12 shows only the circumferential grooves 244, 245 that are formed in the bearing 19*a*). A pair of long holes 246, 247 are formed in the sleeve 241. The long holes 246, 247 have a predetermined length along the circumference of the sleeve 241. The long holes 246, 247 allow communication between the circumferential grooves 244, 245 and the oil grooves 63, 66 that are formed in the intake cam shaft 11 respectively. As is the case with the first embodiment, the circumferential grooves 244, 245 are connected to the first OCV 60 (see FIG. 1) by the oil grooves 56, 57.

As is the case with the first embodiment, this embodiment makes it possible to inhibit a deterioration in precision in changing a valve overlap period. In addition, this embodiment also makes it possible to widen the range where the valve timing of the intake valves 23 can be changed and to improve startability of the engine 10.

Furthermore, this embodiment employs the drive and driven gears 242, 243 so that the exhaust cam shaft 12 is gear-driven by the intake cam shaft 11. Accordingly, this embodiment achieves a size reduction of the engine 10, as is the case with the third embodiment.

The respective embodiments described hitherto may be subjected to structural modifications, which will be described hereinafter. Such structural modifications cause no substantial change in operation or effect of the aforementioned respective embodiments. In later-described FIGS. 13 through 16, the intake cam shaft 11, the exhaust cam shaft 12 and the crank shaft 15 are illustrated in a simplified manner, and the intake and exhaust cams 27, 28 are omitted.

Figure 13:
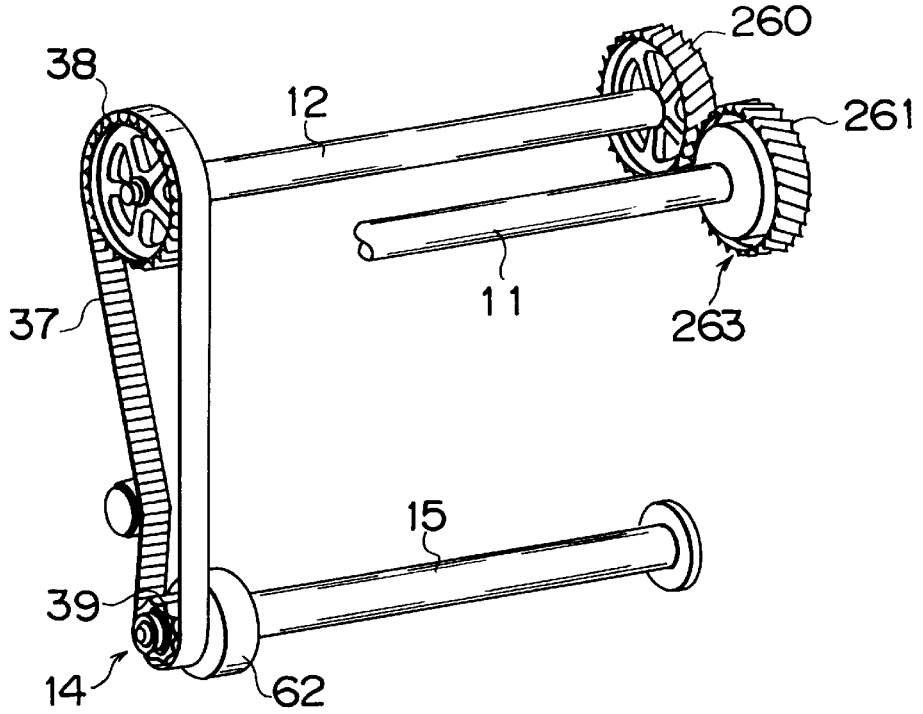
FIG. 13 is a perspective view showing an example of a modified construction of the valve timing changing apparatus.

As shown in FIG. 13, the crank pulley 39 of the second VVT 14 is drivingly coupled to the cam pulley 38 of the exhaust cam shaft 12 through the timing belt 37. A drive gear 260 is unmovably mounted to the exhaust cam shaft 12 at its base end portion. The gear 260 is in engagement with a driven gear 261, which is mounted to the intake cam shaft 11 at its base end portion. A first VVT 263 is mounted to the intake cam shaft 11 at its base end portion. The first VVT 263 causes the intake cam shaft 11 to rotate relative to the driven gear 261, so that the valve timing of the intake valves (not shown) is changed.

Figure 14:
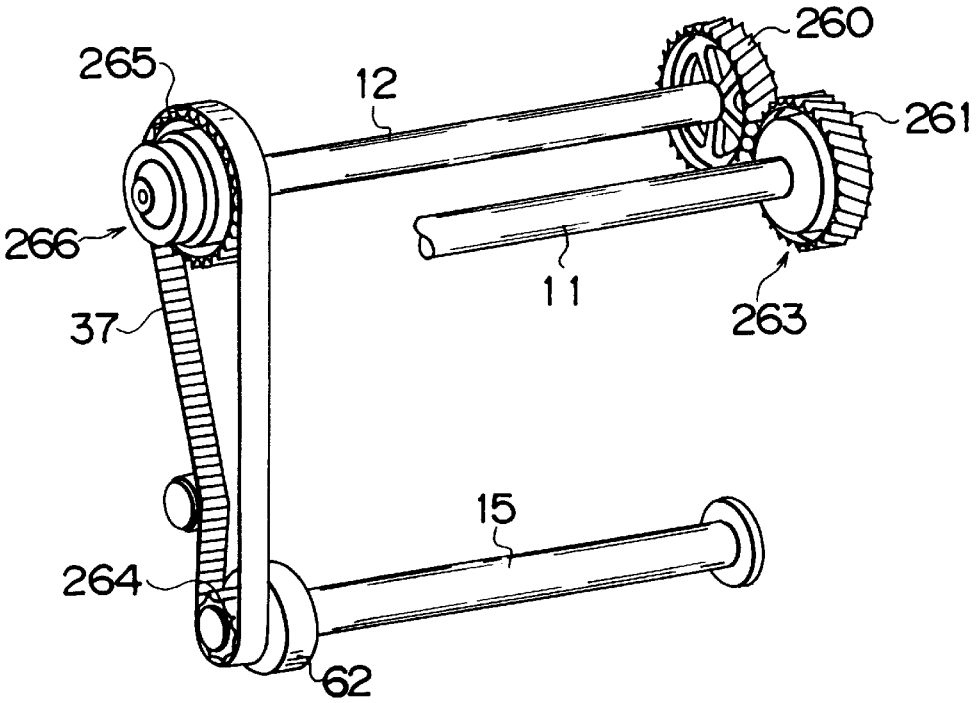
FIG. 14 is a perspective view showing an example of a modified construction of the valve timing changing apparatus.

As shown in FIG. 14, a crank pulley 264 fixed to the crank shaft 15 at its front end portion is drivingly coupled to a cam pulley 265 that is mounted to the exhaust cam shaft 12 at its front end portion through the timing belt 37. As is the case with the structure shown in FIG. 13, the drive gear 260 and the driven gear 261 drivingly couple the intake and exhaust cam shafts 11, 12 to each other. A second VVT 266 is mounted to the exhaust cam shaft 12 at its front end portion. The second VVT 266 causes the exhaust cam shaft 12 to rotate relative to the cam pulley 265. This relative rotation of the exhaust cam shaft 12 causes relative rotation of the intake cam shaft 11, whereby the valve timings of the intake and exhaust valves are simultaneously changed by an equal phase. Further, as is the case with the structure shown in FIG. 13, the first VVT 263 is designed to change a valve timing of the intake valves.

Figure 15:
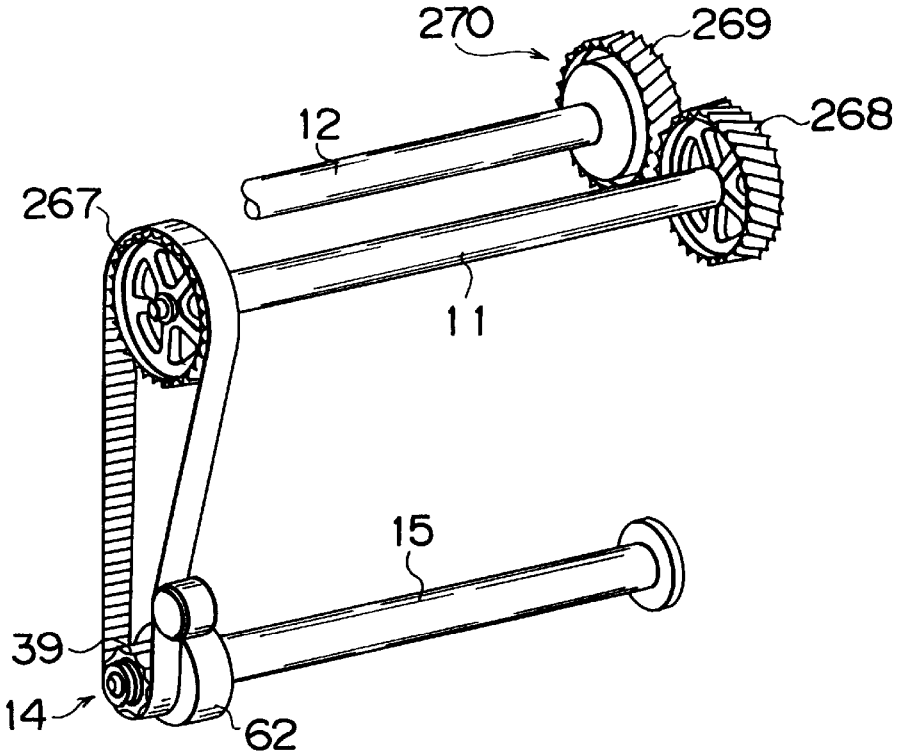
FIG. 15 is a perspective view showing an example of a modified construction of the valve timing changing apparatus.

As shown in FIG. 15, the crank pulley 39 of the second VVT 14 is drivingly coupled to a cam pulley 267 fixed to the exhaust cam shaft 12 at its front end portion through the timing belt 37. A drive gear 268 is unmovably mounted to the intake cam shaft 11 at its base end portion, and a driven gear 269 is mounted to the exhaust cam shaft 12 at its base end portion. The drive and driven gears 268, 269 are in engagement with each other. A first VVT 270 is mounted to the exhaust cam shaft 12 at its base end portion. The first VVT 270 changes a rotational phase of the exhaust cam shaft 12 relative to the driven gear 269 so as to change a valve timing of the exhaust valves.

Figure 16:
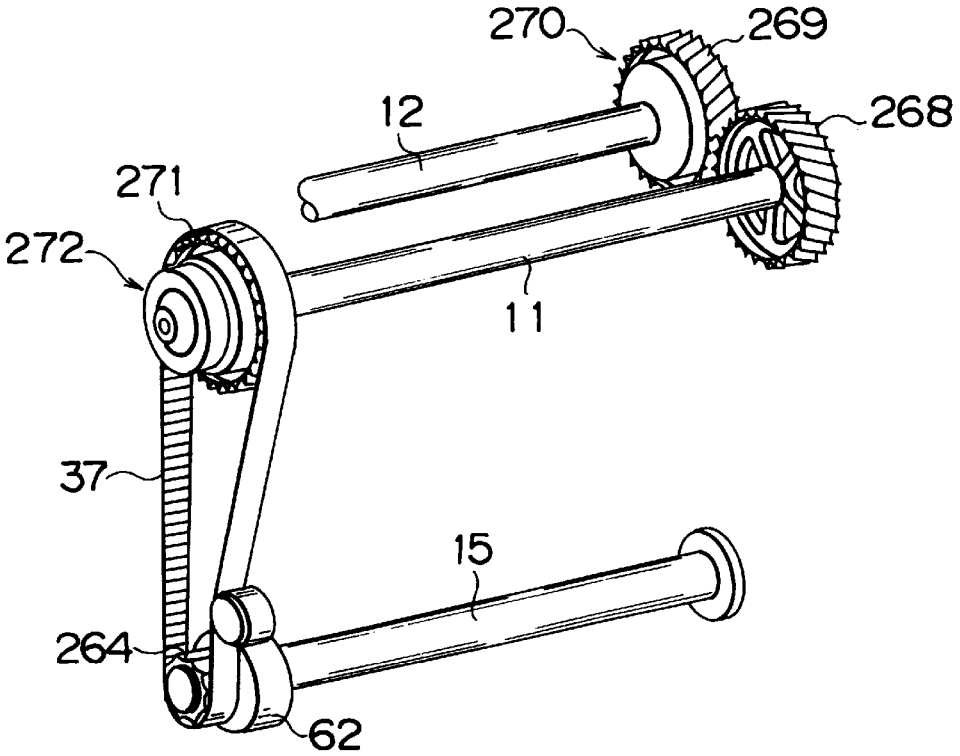
FIG. 16 is a perspective view showing an example of a modified construction of the valve timing changing apparatus.

As shown in FIG. 16, the crank pulley 264 fixed to the crank shaft 15 at its front end is drivingly coupled to a cam pulley 271 that is mounted to the intake cam shaft 11 at its front end portion through the timing belt 37. As is the case with the structure shown in FIG. 15, the drive and driven gears 268, 269 drivingly couple the intake and exhaust cam shafts 11, 12 to each other. Further, the first VVT 270 changes a rotational phase of the exhaust cam shaft 12 so as to change a valve timing of the exhaust valves. Still further, a second VVT 272 is mounted to the intake cam shaft 11 at its front end portion. The second VVT 272 causes the intake cam shaft 11 to rotate relative to the cam pulley 271 so as to change valve timings of the intake and exhaust valves.

In the aforementioned respective embodiments, if oil having a predetermined pressure is not supplied to the first VVT (13, 120, 200, 240, 263, 270) or the second VVT (14, 121, 266, 272), the first and second VVT's are maintained in the most retarded and advanced states respectively. On the contrary, it is also possible to maintain the first and second VVT's at the most advanced and retarded states respectively. In this case, the return spring (110, 180) mounted to the second VVT is abolished. As is the case with the aforementioned return spring (110, 180), a return spring for maintaining the first VVT at the most advanced state is mounted thereto.

For the first and second VVT's 13, 14, the first embodiment employs a VVT (hereinafter referred to as "gear-type VVT") of a type wherein the ring gear 33 or 72 moves so as to change valve timings of the intake and exhaust valves 23, 24. For the first and second VVT's 120, 121, the second embodiment employs a rotary-type VVT. However, each of the first and second VVT's 120, 121 can be constituted by either a gear-type VVT or a rotary-type VVT.

In the aforementioned respective embodiments, the valve timing changing apparatus installed in the four-valve in-line engine 10 has been described. However, the valve timing changing apparatus of the present invention can also be applied to, for example, a V-type engine. In this case, the first VVT is mounted to each bank so as to change a valve timing of the intake valves in that bank.

In the aforementioned respective embodiments, the timing belt or the timing chain is used to transmit a torque of the crank shaft 15 to the intake cam shaft 11, the exhaust cam shaft 12 or both the cam shafts 11, 12. However, gears may also be used to transmit a torque of the crank shaft 15 to the intake cam shaft 11 or the exhaust cam shaft 12.

While the present invention has been described with reference to what are presently considered to be preferred embodiments thereof, it is to be understood that the present invention is not limited to the disclosed embodiments or constructions. On the contrary, the present invention is intended to cover various modifications and equivalent arrangements. In addition, while the various elements of the disclosed invention are shown in various combinations and configurations, which are exemplary, other combinations and configurations, including more, less or only a single embodiment, are also within the spirit and scope of the present invention.

What is claimed is:

1. A valve timing changing apparatus for an internal combustion engine, comprising:

an intake cam shaft for drivingly opening and closing intake valves;

an exhaust cam shaft for drivingly opening and closing exhaust valves;

a first actuating mechanism mounted on a crank shaft, the first actuating mechanism simultaneously changing rotational phases of the intake and exhaust cam shafts; and a second actuating mechanism for changing a rotational phase of only one of the intake and exhaust cam shafts.

2. The valve timing changing apparatus according to claim 1, wherein the first and second actuating mechanisms operate so as to advance or retard the valve timing of at least one of the intake and exhaust valves by means of a hydraulic pressure supplied from a hydraulic pressure source.

3. The valve timing changing apparatus according to claim 2, wherein at least one of the first and second actuating mechanisms is provided with return means for forcibly advancing or retarding the valve timing of at least one of the intake and exhaust valves when a desired operation becomes impossible to perform due to a decrease in hydraulic pressure supplied from the hydraulic pressure source.

4. The valve timing changing apparatus according to claim 2, wherein, when the first and second actuating mechanisms become incapable of performing a desired operation due to a decrease in hydraulic pressure supplied from the hydraulic pressure source, one of the first and second actuating mechanisms is maintained in a most advanced state in which the valve timing of the at least one of the intake and exhaust valves is advanced by a maximum amount, and the other of the first and second actuating mechanisms is maintained in a most retarded state in which the valve timing of the at least one of the intake and exhaust valves is most retarded.

5. The valve timing changing apparatus according to claim 1, wherein the second actuating mechanism is disposed concentrically with respect to one of the intake and exhaust cam shafts and changes a rotational phase of the one of the intake and exhaust cam shafts relative to the other of the intake and exhaust cam shafts.

6. The valve timing changing apparatus according to claim 1, wherein each of the first and second actuating mechanisms is constituted by one of a gear-type variable valve timing mechanism and a rotary-type variable valve timing mechanism.

7. A valve timing changing apparatus for an internal combustion engine, comprising:

an intake cam shaft for drivingly opening and closing intake valves;

an exhaust cam shaft for drivingly opening and closing exhaust valves;

a first actuating mechanism for simultaneously changing rotational phases of the intake and exhaust cam shafts, wherein the first actuating mechanism is disposed concentrically with respect to a crank shaft and changes a rotational phase of the crank shaft relative to at least one of the intake and exhaust cam shafts; and a second actuating mechanism for changing a rotational phase of only one of the intake and exhaust cam shafts.

8. A valve timing changing apparatus for an internal combustion engine, comprising:

an intake cam shaft for drivingly opening and closing intake valves;

an exhaust cam shaft for drivingly opening and closing exhaust valves;

a first actuating mechanism for simultaneously changing rotational phases of the intake and exhaust cam shafts by application of hydraulic pressure wherein, when the first actuating mechanism is inoperable due to unavailability of a required first hydraulic pressure, the first actuating mechanism defaults to a position in which the rotational phases of the intake and exhaust valves correspond to a most advanced state, the intake and exhaust valve timings in the most advanced stated being advanced by a maximum amount; and a second actuating mechanism coupled to the source of hydraulic pressure for changing a rotational phase of only the intake cam shaft by application of hydraulic pressure wherein, when the second actuating mechanism is inoperable due to unavailability of a required second hydraulic pressure, the second actuating mechanism defaults to a position in which the rotational phase of the intake valves corresponds to the most retarded state in which the intake valve timing is retarded by a maximum amount.

9. A valve timing changing apparatus for an internal combustion engine, comprising:

an intake cam shaft for drivingly opening and closing intake valves;

an exhaust cam shaft for drivingly opening and closing exhaust valves;

a source of hydraulic pressure;

a first actuating mechanism coupled to the source of hydraulic pressure for simultaneously changing rotational phases of the intake and exhaust cam shafts by application of hydraulic pressure to adjust the rotational phases of the intake and exhaust cam shafts in a direction away from a most advanced state toward a most retarded state and, when the first actuating mechanism is inoperable due to unavailability of a required first hydraulic pressure, the first actuating mechanism defaults to a position in which the rotational phases of the intake and exhaust valves correspond to a most advanced state, the intake and exhaust valve timings in the most advanced stated being advanced by a maximum amount; and a second actuating mechanism coupled to the source of hydraulic pressure for changing a rotational phase of only the intake cam shaft by application of hydraulic pressure away from a most retarded state and toward a most advanced state and wherein, when the second actuating mechanism is inoperable due to unavailability of a required second hydraulic pressure, the second actuating mechanism defaults to a position in which the rotational phase of the intake valves corresponds to the most retarded state in which the intake valve timing is retarded by a maximum amount, the second actuating mechanism being coupled to the source of hydraulic pressure separately from the first actuating mechanism.

* * * * *